US009616456B1

(12) United States Patent
Jalbert

(10) Patent No.: US 9,616,456 B1
(45) **Date of Patent: *Apr. 11, 2017**

(54) APPARATUS AND METHODS FOR TOOL(S) TO WORK ON BUILDING SURFACE(S)

(71) Applicant: Exceptional IP Holdings, LLC, Cary, NC (US)

(72) Inventor: David B. Jalbert, Coventry, RI (US)

(73) Assignee: Exceptional IP Holdings, LLC

( * ) Notice: Subject to any disclaimer, the term of this patent is extended or adjusted under 35 U.S.C. 154(b) by 403 days.

This patent is subject to a terminal disclaimer.

(21) Appl. No.: 14/154,107

(22) Filed: Jan. 13, 2014

Related U.S. Application Data

(63) Continuation of application No. 12/717,127, filed on Mar. 3, 2010, now Pat. No. 8,628,318.

(60) Provisional application No. 61/157,156, filed on Mar. 3, 2009.

(51) Int. Cl.
*B05C 17/10* (2006.01)
*E04F 21/16* (2006.01)

(52) U.S. Cl.
CPC ..... *B05C 17/10* (2013.01); *E04F 21/161* (2013.01)

(58) Field of Classification Search
CPC .... B05C 17/10; E04F 21/161; E04F 21/1652; E04F 21/1655
See application file for complete search history.

(56) References Cited

U.S. PATENT DOCUMENTS

| | | | | |
|---|---|---|---|---|
| 796,246 | A | | 8/1905 | Printz |
| 2,594,606 | A | | 4/1952 | Ames |
| 2,824,443 | A | | 2/1958 | Ames |
| 2,889,699 | A | | 6/1959 | Ames |
| 3,925,145 | A | | 12/1975 | Ames |
| 4,301,198 | A | * | 11/1981 | Prior ..... E04C 2/246 156/305 |
| 4,451,223 | A | | 5/1984 | Mower et al. |
| 4,619,013 | A | | 10/1986 | Yon |
| 4,664,611 | A | | 5/1987 | Kumar |
| 4,907,955 | A | | 3/1990 | Snipes |
| 5,099,539 | A | | 3/1992 | Forester |
| 5,622,729 | A | | 4/1997 | Mower |
| 5,695,788 | A | | 12/1997 | Woods |
| 5,882,691 | A | | 3/1999 | Conboy |

(Continued)

*Primary Examiner* — Alison L Hindenlang
*Assistant Examiner* — Emmanuel S Luk
(74) *Attorney, Agent, or Firm* — Wolff Law Offices, PLLC; Kevin Alan Wolff

(57) ABSTRACT

The present invention is directed to construction tools. The present invention includes tools used for applying mastic or mud to a work surface, for example, a corner finishing tool that may have a quick engage/disengage ball and socket feature that automatically stays open and automatically closes and locks. Various embodiments may include a universal and interchangeable working/running blade and cooperating frame design. The frame design may be partially held in place with a face or top plate. Various embodiments may include a multiple tension spring design with one or more adjustment arm(s) for varying the tension on the frame(s) and blade(s). Various embodiments may include flat internal walls to accommodate the one or more adjustment arm(s). Various embodiments may also include a input port cone with ball for attachment to, for example, an applicator box, that may be formed from multiple parts that may be made from different materials.

20 Claims, 23 Drawing Sheets

(56) References Cited

U.S. PATENT DOCUMENTS

| | | | | |
|---|---|---|---|---|
| 6,155,809 | A | 12/2000 | Edwards et al. | |
| 6,413,006 | B1 | 7/2002 | Neugart | |
| 6,427,877 | B1 | 8/2002 | Trout | |
| 6,581,805 | B2 | 6/2003 | Conboy et al. | |
| 6,685,784 | B1 | 2/2004 | Jacino et al. | |
| 6,776,551 | B2 | 8/2004 | Linnenbuerger | |
| 7,114,869 | B2 | 10/2006 | MacMillan | |
| 7,246,402 | B2 | 7/2007 | Washburn | |
| 2002/0046541 | A1 | 4/2002 | Grunst | |
| 2002/0074361 | A1 | 6/2002 | Trout | |
| 2005/0005386 | A1* | 1/2005 | MacMillan | E04F 21/00 15/245.1 |
| 2005/0045264 | A1* | 3/2005 | Kooistra | E04F 21/08 156/71 |
| 2005/0100386 | A1 | 5/2005 | Murray | |
| 2006/0174437 | A1* | 8/2006 | Washburn | E04F 21/1655 15/235.7 |
| 2010/0260530 | A1 | 10/2010 | Schlecht et al. | |

* cited by examiner

APPARATUS AND METHODS FOR TOOL(S) TO WORK ON BUILDING SURFACE(S)

This application claims priority to, and is a continuation of, U.S. patent application Ser. No. 12/717,127, filed on Mar. 3, 2010, now to issue as U.S. Pat. No. 8,628,318, which claims benefit of U.S. Provisional Patent Application No. 61/157,156, filed Mar. 3, 2009. These prior patent applications are hereby incorporated by reference for all purposes.

FIELD OF THE INVENTION

The present invention pertains to methods and various apparatus for building and/or construction tools. For example, the invention involves various apparatus and methods for building tools for finishing various building surfaces which provide improved retention, function & durability.

BACKGROUND

Various tools have been known in the past for working with cements, concretes, mastics and/or muds to, for example, prepare, apply and finish a desired shape or smooth surface for various building surfaces. For example, some tools used for preparing the surface of, for example, concrete, include trowels. Another example are various tools used to prepare and finish, for example, mastics and mud for drywall, including, flat boxes, corner finishing boxes, corner finishing tools, and automatic taper (taping) machines. Some examples of various previously known corner finishing tools may be found in U.S. Pat. Nos. 2,824,443; 5,419,693; 5,423,666; 5,622,729; 6,155,809; and 7,114,869: among others. In any case, regardless of type, these tools are often hand tools that are used to apply substances to and/or smooth various building surfaces, such as walls, ceilings and floors, and often result in skilled craftsman working on a number of surfaces for long periods of time during the work day. As such, the weight of the tool, ease of use, and quality of quick results may contribute to its appeal to the skilled craftsman.

For many of these tools, one aspect of improving their usefulness during the working day includes a quick yet high integrity attachment, retaining, and releasing system, so that the tool can be utilized both with injected mud as an applying tool, and without injected mud, as a spreading tool. Similarly, a corner finishing tool may be used with, or without, a corner finisher applicator box. Proper functioning of the tool includes how it glides along the surfaces, for example, a corner joint of drywall. The mechanical durability is also an important aspect of various designs for such tools. One particular example of an attachment system, is the ball style attachment, retention, and releasing system for a corner finisher applicator and finishing tool 100, that is illustrated in FIG. 1

Referring to FIG. 1, in this illustration the ball end 115 of a corner finisher applicator box 110 is snapped into socket 125 of the finishing tool 120 and retained or held in place by a retention clip or spring 105A, 105B. The applicator box 110 can be attached to the corner finishing tool 120 so as to provide mud or mastic from the applicator box 110 through the corner finisher tool 120 to, for example, a corner interface of two wall portions or a ceiling and wall of drywall sheets. Removal or disengagement of the tools is often needed during use of the tools, and in this case requires pulling the finisher tool 120 off of the applicator box 110. However, these attachment, retaining, and releasing systems or mechanization are known to fatigue the retention clip or spring 105A, 105B during use, resulting in tools which fall off during use and need to be repaired frequently by, for example, replacement of the retention clip or spring 105A, 105B.

FIGS. 2, 3A, & 3B show some other known attachment, retaining, and releasing systems used with corner finisher tools and corner applicator boxes. In these examples, various types of attachment, retaining, and releasing mechanism are employed to attach, retain, and release a corner finisher tool 220 (e.g., 120 in FIG. 1) to either an applicator box (not shown in FIG. 2 or 3; 110 in FIG. 1), or handle end 215 (not shown in FIG. 1 or 3). Referring to FIG. 2 a corner finishing tool and handle tool setup 200 is provided, including an attachment, retaining, and releasing system including levers 230A & 230B. In operation, levers 230A & 230B are rotated inwardly against a spring force applied by spring 222. In doing so, relief cuts in shafts 235A and 235B are rotated into an open position (moved outward) allowing the ball end 215 of handle 210 to be removed from the corner finishing tool 220 through the enlarged opening 225, thereby releasing it from the handle 210. When released, levers 230A & 230B are allowed to return to an orientation where the attachment ball 215 is either locked out of the tool or locked into the corner finishing tool 220 by shafts 235A and 235B.

Referring now to FIGS. 3A and 3B, a further example of a prior art attachment, retaining, and releasing system for attachment of a ball end fits into a socket section 310, 315 of either a handle or corner applicator box is accomplished by the sliding of a sheet metal interlocking piece 305 with and engaging and disengaging slot 325. This action is done against a biasing spring 307. In this system, as in the above system, the retaining and releasing mechanism (sliding sheet metal interlocking piece 305) is held in position by a biasing spring 307 and requires user motion to release the retaining and releasing mechanism for either engaging or disengaging a corner by using a tab 330 attached to the sliding sheet metal interlocking piece 305. For example, FIG. 3B shows the sliding sheet metal interlocking piece 305 in its releasing position wherein the biasing spring 307 is compressed and the wider opening portion 320A of the sliding sheet metal interlocking piece 305 is located around the socket section 310, 315. This position is achieved by a user pushing on tab 330. In this position, the ball end of a corner applicator box of handle (that is smaller than the large opening 320A) is insert through the large opening 320A and fit into the socket section 310, 315. FIG. 3A on the other hand, shows the sliding sheet metal interlocking piece 305 in its retaining position wherein the biasing spring 307 is expanded and the narrow opening portion 320B is located around the socket section 310, 315. In this position, a ball end (of a larger diameter than the socket section 310, 315 and the narrow opening portion 320B) of either a handle or corner applicator box may have been placed in the socket section 310, 315 and thereby be retained therein during use of the corner finishing tool.

However, these prior art embodiments have problems associated with high cost to produce and/or sharp edges which have been known to cut into the geometry of the ball end (e.g., 115 and 215) thereby shortening the life of the tools. In addition, all these prior art attachment, retaining, and releasing systems require additional effort by the user to actuate, for both attachment and release of the finishing tool to the applicator box or handle.

In another aspect of the prior art, these corner finisher tools operate in a manner such that the tools are moved along a corner of a room under construction while applying and or spreading "mud" or "mastic" materials intended to fill gaps and/or smooth the surface finish. The finished surface of the "mud" or "mastic" is made smooth by the wiping action of the "blades" in the finishing tool. One example of prior art for these corner finisher tool blades can be seen in FIG. 4.

Generally, there are two types of blades in the known corner finisher tools. The main or working blades 420A and 420B are primarily responsible for leaving a nice finish in the mud as it flows out of the central region of the tool 405A and 405B and under the working blades 420A and 420B. These blades have an angled surface at one end 425A and 425B allowing the 2 blades to come together to form a point which relates to and defines the inner most geometry of the 'corner' of the wall and/or wall to ceiling interface. A second set of blades, running or width control blades 440A and 440B, are mounted in the tool frame 410A and 410B at right angles to the working blades 420A and 420B. These running or width control blades 440A and 440B control the width of the applied mud and glide along the wall and/or ceiling surface during use, ideally allowing little to no mud to pass under them. These blades are typically shorter than the working blades and have both ends squared off at 90 degree angles from their longitudinal sides (not pointed). Corner finisher tool sizes typically vary from 2" to 4" wide. For these size tools the running or width control blades are typically 2.5" long, regardless of the tool size. The larger tools allow for a greater width of mud in each corner making blending of corner imperfections easier. However, motion of the tool along the corner can become less smooth especially as tool size increases, partially due to the shorter length of the running or width control blades relative to the working blades 420A and 420B. Some prior art corner finisher tools have included the added complexity of wheels in various locations to improve the tools motion along the corner. However, these wheals and related parts are know to increase the problems with tool cleaning, get stuck during operation, and wear out quickly in the abrasive "mud" or 'mastic" environment.

SUMMARY

The present invention is directed generally to tools that may, for example, be reduced in cost to manufacture and use, lightweight, high quality, corrosion resistant, durable, strong, easy to assemble and disassembly, and easy to clean. Various embodiments of the present invention may include various building tools that may be used, for example, to apply and/or smooth mastic or mud in the construction industry. For example, various embodiments may include a mastic applicator including a container or housing and/or a corner finishing tool. The mastic applicator and/or corner finishing tool may be made from multiple pieces or sections, wherein each piece or section may be made of, for example, metal, plastic, etc., and may be used for applying and/or smoothing mastic or mud to, for example, drywall board on walls and ceilings of buildings. The corner finishing tool may be attached to, for example, a cone and ball portion of the mastic applicator and/or a ball at the end of a handle so as to apply and/or smooth mastic or mud to a corner of a working surface to fill and smooth wall(s) and/or ceiling corner junction.

In various embodiments of the invention, the finishing tool may coupled to either a handle or applicator box using a ball and socket construction. This configuration allows for relatively free rotation in all directions in order for the tool to align itself against the corner forming walls regardless of the orientation of the handle. The coupling ball may also be either solid for use on a handle to remove excess mud from a corner, or hollow to allow mud to flow from an applicator box to the corner surfaces when it is desired to apply mud to the corner. A critical aspect of this is the way in which the ball coupling is locked to the tool so that it is securely attached while also being free to rotate through the desired range of motion. The corner finishing tool of the present invention may include a quick connect/disconnect system that may open and remain open for reloading in a single movement of a tab and/or pin release and hold.

During use of Corner finishing tools there is often need to use the tool on a handle to remove excess material from a corner after "mud" and tape have been applied, and to use it in conjunction with a mastic or mud applicator box. The mastic applicator box may include a multi-piece cone and ball output port. As a result of varying ceiling heights, there is often a need to use different length handles. Corner finishing tools can be expensive precision tools which results in the user often having only one corner finishing tool available. This results in the finishing tool being removed and reattached to various handle configurations during the course of completing one job. Therefore it is advantageous for the tool to be quickly and easily removed and quickly and easily re-attached to the different handles with a minimum of effort and movements, while being durable and effective at retaining coupling to each handle in a reliable way with no loss of function over extended usage of the product. The present invention may achieve this and other objectives in a cost effective and reliable way that requires little or minimal effort by the user. Various embodiments may include a single manual stroke design that may include a hinged latching mechanism and/or an opening, holding, and locking pin configuration for attaching and releasing a coupling or connecting ball.

In various embodiments, the corner finishing tool may include a quick connect/disconnect arrangement that may include a socket portion and a locking portion that can quickly and reliably allow for the removal and connection of the corner finishing tool to a mastic applicator and/or a handle having a ball connection end (i.e., a quick disconnect ball and socket arrangement). In various embodiments, the finishing tool quick connect/disconnect system or ball attachment system may be a pivoting or hinged door that automatically pivots and latches upon insertion of a coupling ball found on, for example, a applicator box or a handle. In various embodiments the finishing tool may include a finishing tool quick connect/disconnect system or ball attachment system that opens and remains open when a connection or coupling ball is removed in response to a single motion of an activation tab or pin, until pressure is applied by, for example, the same or another coupling or connecting ball being inserted, or pressure applied by a user. In various embodiments, the invention may include a connecting ball made of a two-piece cone output port coupled to an applicator box.

In various embodiments the finishing tool may include a finishing tool quick connect/disconnect system or ball attachment system that may open and close to release and/or hold a coupling or connection ball for a mastic applicator box and/or handle with a coupling or connecting ball. In various embodiments, the finishing tool may include a ball and socket construction that may include a door or ball retention member that may be in the shape of a "C" or "U" that may be attached to a center piece or post that connects to the finishing tool body so as to open outwardly and close inwardly. The connection may be achieved using, for example, a hinged configuration, and the hinged configuration may be achieved using a separate or integral pins that may be affixed to the center piece or post. Another end of the quick connect/disconnect system or ball attachment system hinge pins may be coupled to the body of the finishing tool. The quick connect/disconnect system or ball attachment system may be constructed to remain open when a connection or coupling ball is removed, so as to be in a position to quickly receive another connection or coupling ball. This may be achieved by including a spring loaded slide and pin arrangement, a ridge and spring tension ball arrangement, or a number of other mechanizations that allow the "C" or "U" shaped ball retention member to lock firmly in a closed position and release with user motion when desired to be opened to release a coupling or connection ball when desired. The mechanism may include a gripping or release tab and slide that may be spring loaded to allow it to release the "C" or "U" shaped ball retention member and/or lock the "C" or "U" shaped ball retention member in the closed and/or open position. The quick connect/disconnect system or ball attachment system may include an automatic close or couple mechanism that may be activated by inserting a connection or coupling ball into the socket portion of the corner finishing tool. The automatic close or couple mechanism may be a center post that may be contacted by the connection or coupling ball. The automatic close or couple mechanism may be formed in the shape of the socket, for example curved in a concaved arc that may mate closely to the shape of the connection or coupling ball. The quick connect/disconnect system or ball attachment system may open in response to a single motion of, for example, an activation tab or pin, until pressure is applied to the automatic close or couple mechanism by, for example, the same or another coupling or connecting ball being inserted, or pressure is applied by a user.

Various embodiments of the corner finishing tool of the present invention may have unique blade(s) and frame(s) designs. Various embodiments may also include using a 'square' geometry for all size tools and/or a reversible blade. In various embodiments, a blade and frame may be designed so that the blades may be reversible and/or interchangeable between a working blade and a running blade. In various embodiments, a working blade and a running blade geometrical shape and size may be made the same so that they may be used interchangeably and/or so as to provide a back-up blade for one another in case of wear or damage. The blades may have opposite elongated sides that are of different geometries, one elongated side may be shaped for use as a working blade and the other may be shaped as a running blade. As such, the same blade may be used as either a working blade or as a running blade. In various embodiments, the frame of the corner finishing tool may be made approximately equal in its length along the direction of motion and the direction of frame reach, or tool size, in all sizes of corner finishing tools including the larger size corner finishing tools (e.g., 3"×3" tool, 3.5"×3.5", and larger). With this geometry the larger tools may have a greater width along the direction of motion and improve the smooth movement along a working surface. Also, having approximately equal length on each of the working blade and running blade frame sides may enable the blades to be the same length for all sizes of the corner finishing tools. As a result of this unique frame & blade construction, the user always has the benefit of spare blades found directly on the tool in case one or more should be damaged in use. In doing so, the user may reverse the blades and expose new surfaces which were previously protected inside the frame channels. Further since all four blades on the corner finishing tool may be identical in shape and size, the blades can be switched form side to side as well, resulting in many combinations of defective surfaces being accommodated such that the tool can be set up as 'new' by, for example, placing the damaged surfaces inside the frame channels leaving undamaged surfaces available for proper tool function. In various embodiments, frame grooves may be cut in a novel geometry and/or the blades main surfaces may not be parallel. The frame groves may be cut so that the location where the running blades meet the working blades, a grove for the running blades is slightly deeper than that of the working blade so the edge of the running blade is slightly lower than and edge of the working blade. In this way the blades can be easily and correctly removed and replaced in the field.

Details on blade force system: multiple springs with different geometries and tension adjustment arms In various embodiments, the invention may include a blade force system that may include a plurality of tension springs. The tension springs may adjustably apply tension to a corner finishing tool frame and/or blade(s) so as to apply a desired amount of force of the blade(s) to a working surface (e.g., a wall or ceiling) so as to form a desired pattern, shape, or smoothness of, for example, wall and/or ceiling corner that is, for example, 90 degree interface of two working surfaces. The adjustable blade tension system may include one or more blade tension adjustment lever(s) or handle(s). There may be, for example, two springs for each side of the corner finishing tool frame associated with one set of working and running blades (i.e., four springs in total, two springs on each half frame). The two tension springs on one side or half of the frame may be made with different geometries from one another so as to enable one of the lever(s) or handle(s) to fit there between and slide so as to lift one of the two tensions springs off of the frame in a disengaged manner. In this way, the spring system tension may be adjust so that either one or two total spring forces may be applied to the frame and/or blades. The levers or handles may operate independently so that the spring tension on one half of the frame or blades may be different than the spring tension applied to another half of the frame or blades.

In various embodiments of the invention, a novel face plate construction may be employed at, for example, a top interface of the frame and/or working blade retention channels or grooves. The face plate structure may utilizes, for example, a two piece construction including the face plate and a bracket. The face plate may cover, for example, the front of the frame up to and abutting the front face of the blades. The face plate may have a lip or protrusion that wraps aroung the top corner or vertex of the frames where a left and right side frames interface (i.e., the outside 90 degree corner of the corner finishing tool). The face plate may be retained by a bracket, which may be fastened by a screw to the corner finishing tool body. This construction may provide improved tool cleaning capability and fills the gap that occurs between the blades (152) and the frames (151) at the corner or vertex of the tool In various embodiments, the invention may include a connecting ball made of a two-piece cone output port coupled to an applicator box. Each piece of the two-piece cone output port may be made from different materials, one may be of lighter weight than the other. One piece of the two piece output port may be made cylindrical while the other may be an oblong shape or off-center cone shape. The two piece output port cone and connecting ball arrangement may be manufactured using, for example, and insert molding process. The connecting ball portion may include geometries to improve the coupling between the two pieces of the output port.

As will be seen in the figures and the detailed description of the present specification, the above discussion touches on some, but not all of the inventive aspects of the present invention. Thus, this Summary is not intended and does not limit the scope of the present invention, but is only meant to give the reader an overall idea of the invention with enough detail to understand the main aspects (but not all aspects) of the present invention. The reader is invited to read the following and review the figures so as to understand some of the exemplary embodiments of the present invention inn more detail.

BRIEF DESCRIPTION OF THE DRAWINGS

Some of the objects, features and advantages of the present invention will become more readily apparent to those skilled in the art upon reading the following detailed description, in conjunction with the appended drawings, in which.

DETAILED DESCRIPTION

Figure 1:
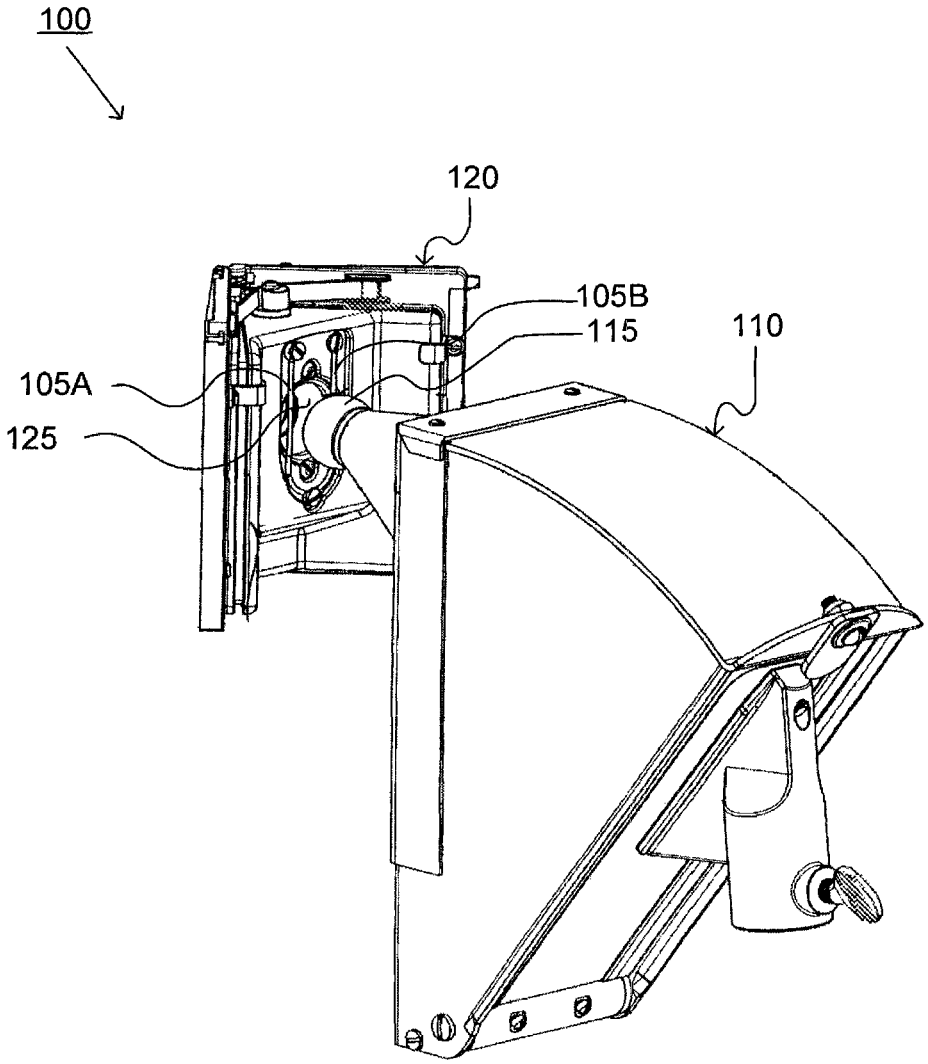
FIG. 1 (PRIOR ART)
FIG. 1 illustrates a perspective view of one exemplary prior art mastic applicator box and corner finishing tool.
Figure 2:
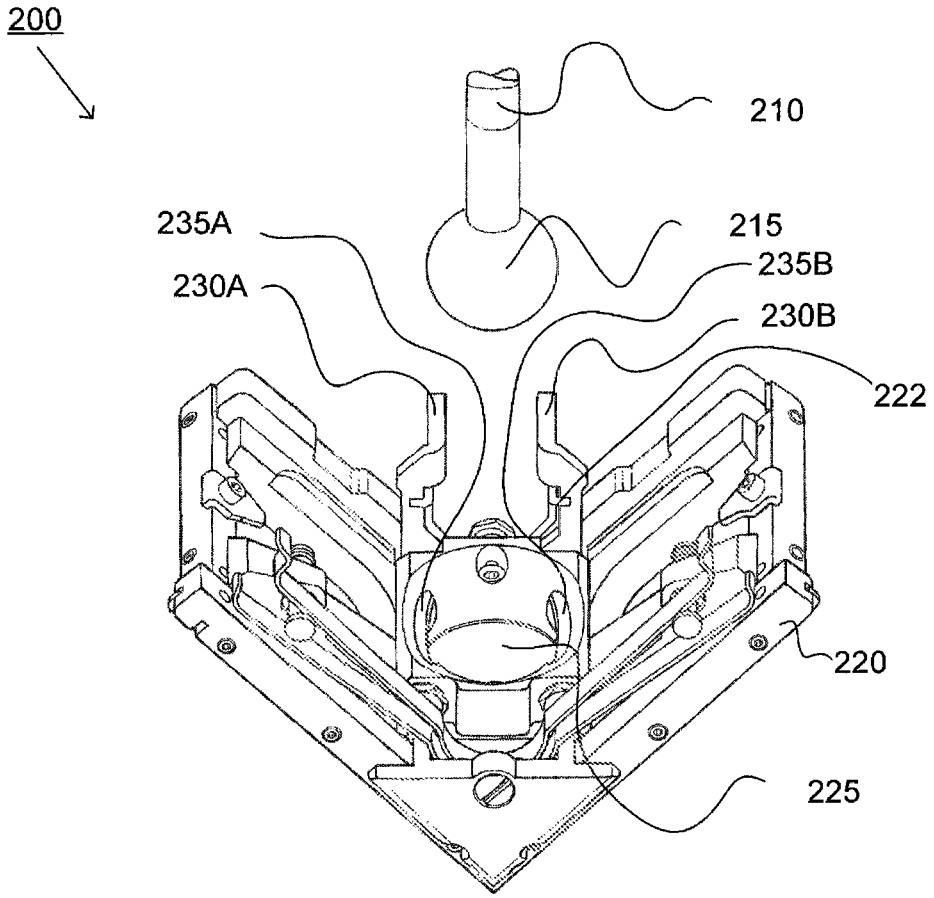
FIG. 2 (PRIOR ART)
FIG. 2 illustrates a perspective view of one exemplary prior art corner finishing tool and handle end ball coupling arrangement.
Figure 3A:
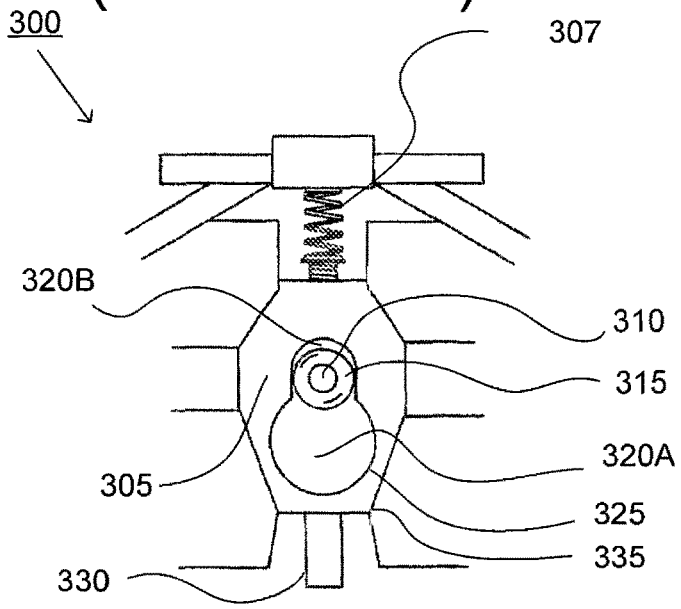
FIG. 3A (PRIOR ART)
FIG. 3A illustrates a schematic view of one exemplary prior art of corner finisher latch mechanism in the latched position.
Figure 3B:
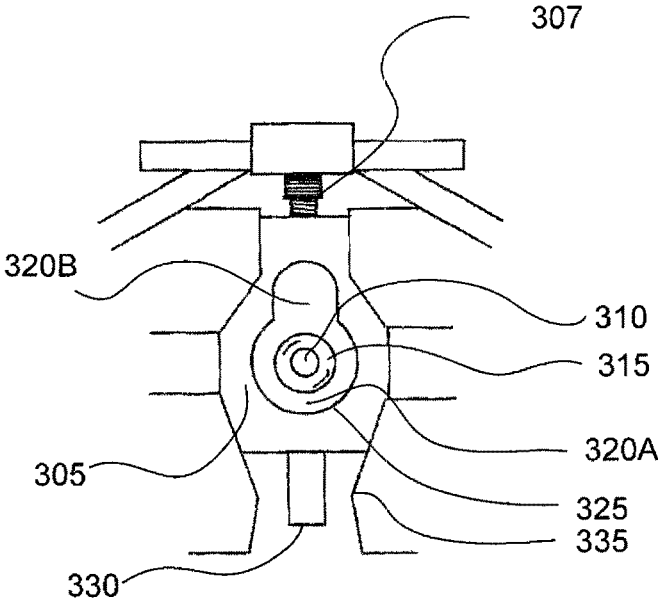
FIG. 3B (PRIOR ART)
FIG. 3B illustrates a schematic view of one exemplary prior art of corner finisher latch mechanism in the unlatched position.
Figure 4:
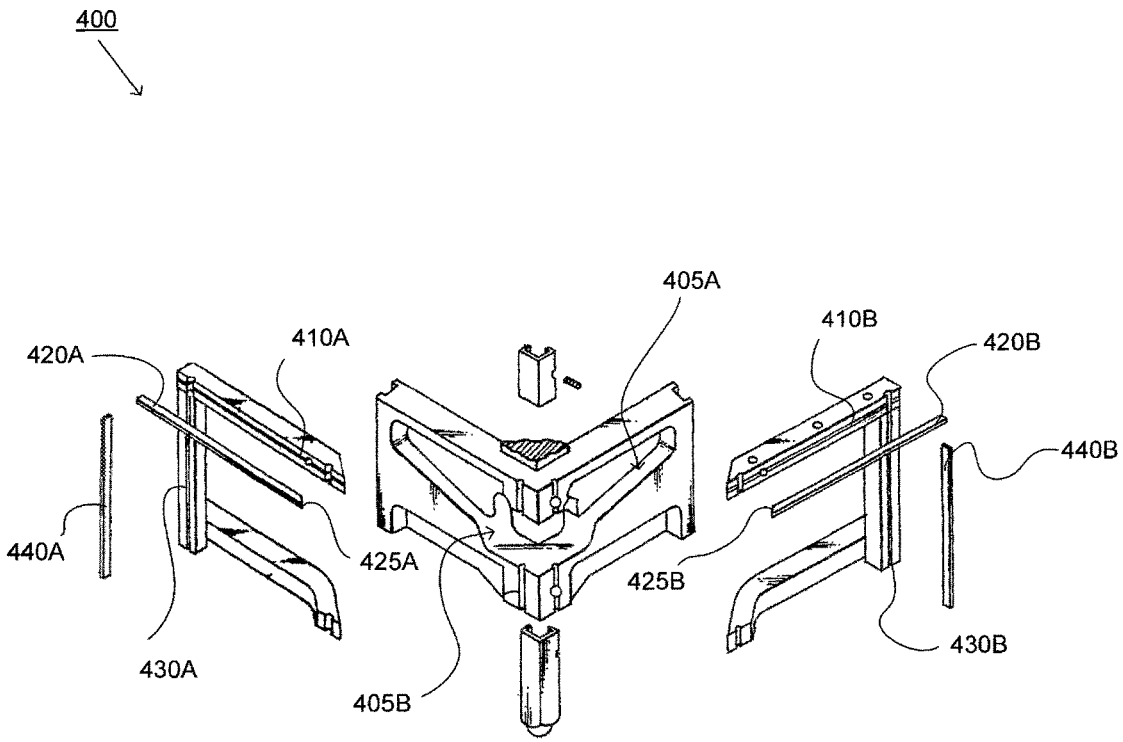
FIG. 4 (PRIOR ART)
FIG. 4 illustrates an exploded perspective view of one exemplary prior art corner finishing tool.

The present invention is directed generally to tools that may be, for example, reduced in cost to manufacture and use, lightweight, high quality, corrosion resistant, durable, strong, easy to assemble and disassembly, and easy to clean. Various embodiments of the present invention may include various tools that may be used in the building and/or construction industry. For example, various embodiments may include tools used for applying mastic or mud to a working surface, such as drywall wall and/or ceiling construction. The various embodiments of the present invention may include, for example, a mastic applicator including a container or housing and/or a corner finishing tool. The mastic applicator and/or corner finishing tool may be made from multiple parts, pieces or sections, wherein each part, piece or section may be made of, for example, metal, plastic, etc., and may be used for applying and/or smoothing mastic or mud to, for example, drywall board on walls and ceilings of buildings. The corner finishing tool may be attached to, for example, a cone and ball portion of the mastic applicator and/or a ball at the end of a handle so as to apply and/or smooth mastic or mud to a corner of a working surface to fill and smooth wall(s) and/or ceiling corner junction.

During use of a corner finishing tool, there is often need to use the tool on a handle to remove excess material from a corner after "mud" and tape have been applied, and to use the corner finishing tool in conjunction with a mud or mastic applicator box. In addition with varying ceiling heights, there is often a need to use different length handles. As such, the user (e.g., a construction worker) may either have multiple corner finishing tools attached in a dedicated manner to a variety of handles and/or mud applicator mechanisms (e.g., applicator box, mud or mastic feed handles, etc.), or one or few corner finishing tools that are interchanged as needed with various types of handles and/or mud applicator mechanisms. However, corner finishing tools are typically expensive precision tools which results in the user often having only one tool available. This results in tools being removed and reattached to various handle configurations during the course of completing one job. Therefore the present invention is advantageous designed so that a corner finishing tool may be easily removed and re-attached to the different handles and to be retained to each handle in a reliable way with no loss of function over extended usage of the product that may result from wear and tear by interchanging or use of a corner finishing tool over time. Furthermore, the present invention may include an attachment mechanism that may be quickly and reliably opened and closed to attach and release from a handle and/or applicator box using, for example, a connecting ball and socket arrangement.

In various embodiments of the invention, the finishing tool may be coupled to either a handle or applicator box using a swivel mechanization that allows the corner finishing tool to pivot freely in, for example, approximately a 30 to 180 degree radius about a mounting point with, for example, a handle and/or applicator box. One such swivel mechanization may be, for example, a ball and socket construction configuration. This ball and socket configuration may allow for relatively free rotation in all directions about a point (e.g., a circular swivel) in order for the tool to align itself against the corner forming walls regardless of the orientation of the handle and/or mud applicator box. The coupling ball may also be, for example, solid for use on a handle to remove excess mud from a corner, or hollow to allow mud to flow from an applicator box to the corner surfaces when it is desired to apply mud to the corner. One aspect of this design is the way in which the ball coupling is locked to the tool, an attachment and release system, so that it is securely attached while also being free to rotate about a point through the desired range of motion and a quick and easy means of releasing the corner finishing tool.

In various embodiments, the present invention may include a mud or mastic applicator box including a bi-material output port. One exemplary bi-material output port may be in the shape of an offset cone that may include an offset portion of one material and a conical shape of another material, as illustrated in co-pending U.S. provisional patent application Ser. No. 61/094,053 Titled Apparatus and Methods for Building or Drywall Tools filed on Sep. 3, 2008, hereby incorporated herein by reference in its entirety for all purposes. Mud or mastic being pushed out of a housing (e.g., and applicator box) may be transferred through a cone shaped feature, which may be at least partially a conical shape, to cause the material to flow out of a small opening. In various embodiments the cone may be designed so as to transfer the mud or mastic to the building surface without unduly raising the pressure required to move the mud out of the housing.

The cone shaped feature of the tool may include a nipple or ball shaped connection that the mud or mastic then flows through and that connects into a tool specifically design to distribute mud on the wall surface, for example, a corner finishing tool. The cone, which may be at least partially a conical shaped structure, may be instrumental in providing a channel from the mud storage tool housing or container to the mud applying tool, e.g., a corner finisher tool. In various embodiments of the invention the cone shaped or at least partially conical shaped, structure may be produced from two parts rather than one single part. The ball end or connection structure of the cone or at least partially conical shaped structure may be produced from, for example, a metal such as stainless steel, for its strength, wear and corrosion resistance. The ball end or connection structure may be combined with or molded with a cone or conical shaped wall structure using a material which may be light weight, low cost, strong and corrosion resistant, for example a plastic material. For example, the ball end or connection structure may be insert molded with a plastic type material so as to form a bi-material structure. The plastic material may be a rigid petroleum based or synthetic based material that has the desired structural and formability characteristics. The plastic material may include fiber. The output port of the cone may be offset from center, for example, may be shifted more closely to the front wall of the container or housing. The side walls of the resulting bi-material cone shaped or at least partially conical shaped structure may have a single angle pitch from a flange end to the ball end, or may include a plurality of angles on one or more sides as desired. The plurality of angles may improve manufacturability of the at least two piece structure, may improve the pivoting aspects of a corner finisher tool on the cone, and may help place the cone and ultimately the corner finisher tool attached thereto, closer to the front wall of the container or housing upon which the cone may be mounted. Further, the walls may be made thicker in the plastic portion than the metal portion, if desired, to provide better adhesion to one another and better strength. The resulting bi-material cone shaped or at least partially conical shaped structure including a nipple, formed of two different materials, may then be mounted to existing tools the same way traditional cones have been mounted or in alternative ways that may be more cost effective to manufacture and assemble. However, the new part may now be designed to meet the varying needs of each region of the part by utilizing the best material for that area. The lighter weight material section structure, for example plastic, may be molded over and/or through portions of the ball end section to ensure that the overall cone shaped or at least partially conical shaped structure including the ball end never separates under the stresses found on the job site for tools of this nature. In various embodiments, the stainless steel and plastic materials may be made of various different combinations of materials, for example, Stainless steel with aluminum, plastic with aluminum, plastic with zinc, etc., as long as the materials for each section meet the desired characteristics and may be manufactured.

Figure 5:
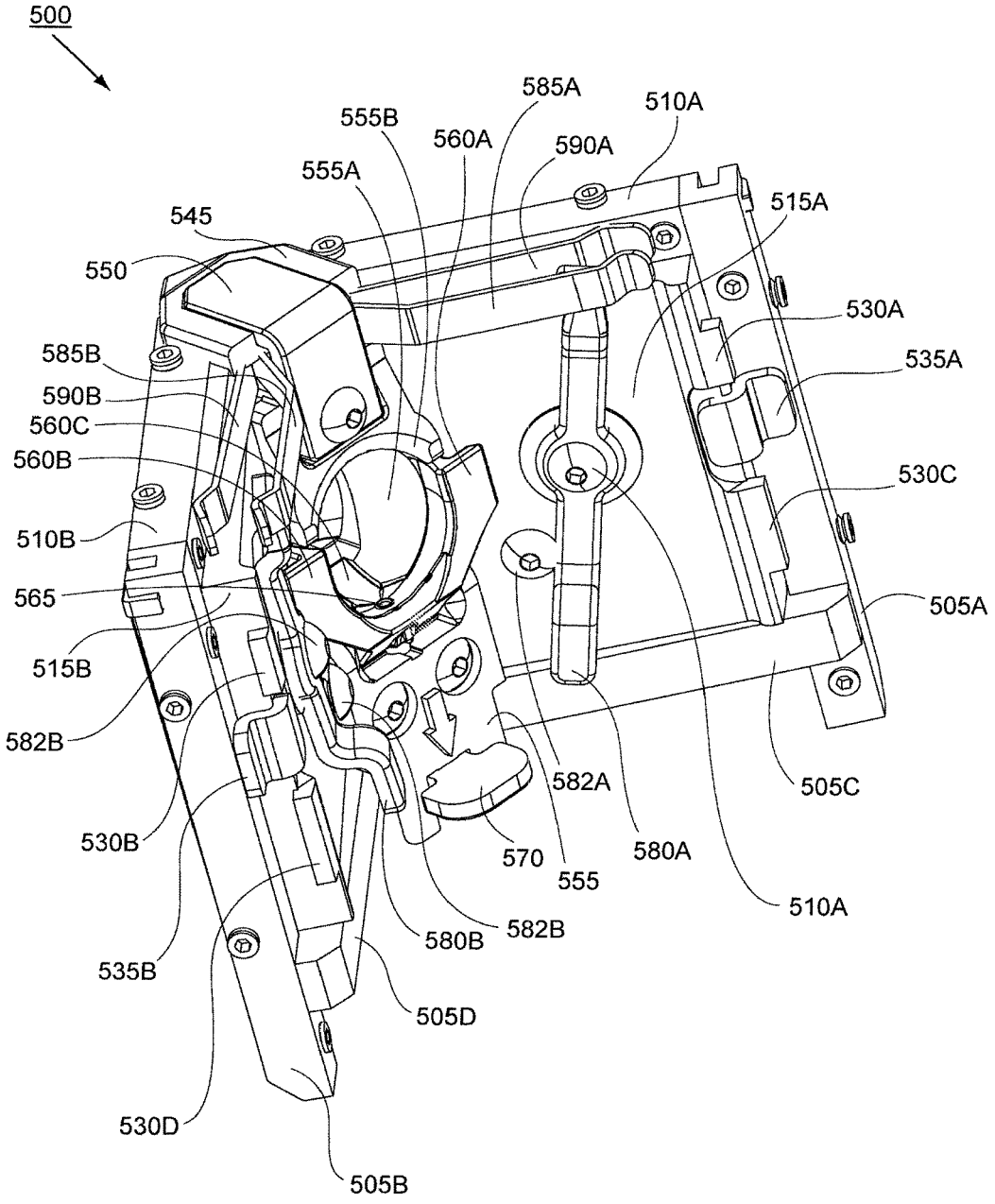
FIG. 5 illustrates a perspective view of a corner finishing tool looking from the top at the inside surfaces of the corner finishing tool, according to at least one exemplary embodiment of the invention.

Referring now to FIG. 5, a perspective view of a corner finishing tool looking from the top at the inside surfaces of the corner finishing tool is provided, according to at least one exemplary embodiment of the invention. As will be described in more detail below, the corner finishing tool 500 may include four cooperating and interrelated sections or systems, a frame and blade section, an interior wall section, a handle and/or application box coupling system, and a frame spring tension system. In various embodiments, a corner finishing tool 500 according to various embodiments of the present invention may be general constructed with a plurality of frame sides, 505A, 505B, 505C, 505D, 510A and 510B, that are attached together to form an approximately 90 degree angle (so as to fit or form an interior angle of, for example, a wall-to-wall junction, a ceiling-to-wall junction, etc.). Frame sides 510A and 510B may be for holding one or more working blades (not shown), respectively. Frame sides 505A and 505B may be for holding one or more running blades (not shown), respectively. The frame sides frame sides, 505A, 505B, 505C, 505D, 510A and 510B, may be attached together using conventional attachment means, for example, welding, screws, etc. The frame sides 510A and 510B may have a face plate 545 covering their interior joint at a top vertex of the corner finishing tool 500. The face plate 545 may be held in place by a bracket 550 that may have an L shape. The frame sides, 505A, 505B, 505C, 505D, 510A and 510B, may be moveably coupled to an interior cornered side-wall plate(s) section of the corner finishing tool 500, that may include sides 515A and 515B. The interior cornered side-wall plate(s) may be formed of a single structure using, for example, a metal casting process, so that sides 515A and 515B are integrally formed together, or may be two separate parts that are connected together using, for example, conventional connecting means (e.g., welding, screws, etc.).

The interior cornered side-wall plate(s) section may be formed to be at an angle that may be slightly less than approximately a right or 90 degree angle. In any case, the inside wall section or inter-face of sides 515A and 515B may be made to be a generally flat surface with movement limitation or retention tabs, e.g., 530A, 530B, 530C and 530D, that will stop the frame sections 505A, 505B, 510A and 510B, and their related working and running blades from moving beyond these tabs in the rearward direction and separating from the inside wall section. On the other hand, the outer face side of sides 515A and 515B may be formed to include cavities, valleys, or concave sections (not shown) that may help distribute and/or accumulate mud or mastic to be applied to or smoothed on a working surface (e.g., wall or ceiling). Further, the frame sections 505A and 505B may also include one or more movement limitation or retention tabs 535A and 535B, respectively, that may be connected to the frame sections using conventional connecting means (e.g., welding, screws, etc.) and act as a stop for the forward movement of the frame sections 505A and 505B relative to the interior cornered side-wall plate(s) section. As such, the movement of the frame sections and related blades is limited by the tabs or ears 530A, 530B, 530C, 530D, 535A and 535B, on the interior cornered side-wall plate(s) and frame(s), and can thus only move a short distance in either the forward or backward directions from the face of the slightly less than approximately 90 degree interior cornered side-wall plate(s) structure. The actual relative location and movement of the frame sections 505A, 505B, 510A and 510B (with working and running blades), may be controlled by the spring tension system that will be described in more detail below.

Various embodiments of the present invention may include a corner finishing tool handle and/or application box coupling system. For example, a ball and socket system female portion bracket 550 may be formed as an integral socket 555A and top lip 555B, as shown in this embodiment. The female portion bracket 555 may be coupled or connected to the interior side wall section. The socket 555A may be provided as a seat for a ball to be received in the female portion bracket 550. The top lip 555B may be formed integral with the female portion bracket 550, and may provide a means for gripping or retaining the ball to be received. The handle and/or application box coupling system may also include a hinged U or C shaped door 560 that may cooperate with top lip 555B. The door 560 may include a right side arm 560A with lip, a left side arm 560B with lip, and a rear arm or post 560C. The right side arm 560A with lip and left side arm 560B with lip may cooperate with top lip 555B to form an oval or circular structure that is smaller than at least the largest diameter of a ball end (of, for example, a handle or mud application box cone) so as to surround and retain the ball into the socket 555A. The rear arm or post 560C may form a portion of a hemispherical surface of the socket 555A when the door 560 is closed so as to retain a ball end, and may operate to automatically activate closure and/or locking of the door 560 when receiving a ball end. The door may include a locking hole 565. The handle and/or application box coupling system may also include a lock and release pin (not shown) and a lock and release pin handle or tab 570 that may be spring loaded such that when the door 560 is closed the pin may be force into the hole 565 via spring force (using a tensioning spring) and when the door is open the spring asserts pressure on the pin so as to hold the door 560 in an open position. To release the door (and thereby release a ball retained therein), a user may push down on handle or tab 570 (in the direction of the arrow) so as to remove the pin from hole 565 in door 560. The pin may then latch the door in the open position via the force applied to the pin by a tension spring (not shown). The door 560 may be closed and locked automatically by inserting a ball against the post 560C and into the socket area 555A, thereby releasing the pin an spring to insert itself into the hole 565 in the door 560. As such, the present invention provides a quick and easy ball and socket locking and release system. This function and operation will be described further below.

Further, various embodiments of the present invention may include a corner finishing tool spring tension system. The spring tension system may include one or more springs, e.g., springs 585A, 585B, 590A and 590B, associated with each side of the corner finishing tool frame for allowing the blades of the corner finishing tool to vary in their angular relationship to one another and a working surface(s). The springs 585A, 585B, 590A and 590B may be a leaf type spring structure and may be of varying geometry or bending relative to one another. For example, a first set of springs closest to and interfacing with the frame portions, e.g., springs 590A and 590B, may be formed so as to have a side profile that is relatively flat along it lateral length except for a very end that interfaces with a surface of the frame 510A and 510B. A second set of springs closest to and interfacing with the frame portions, e.g., springs 585A and 585B, may be formed so as to have a side profile that is bent or bowed outwardly along it lateral length and bent where it interfaces with a surface of the frame 510A and 510B or the other set of springs. As a result of the bend or outwardly bow, springs 585A and 585B may allow handles, wipers, or tension adjustment arms 580A and 580B to be moved under springs 585A and 585B so as to lift them up and disengage them so they may not apply spring tension to the frames 510A and 510B. In this way, the spring tension system is adjustable to apply more or less tension to one or both of frames 510A and 510B. Handles, wipers, or tension adjustment arms 580A and 580B may be coupled to the inter wall member via a screw 510A and MOB, respectively, so as to pivot thereabout. A pivot stop 582A and 582B, respectively, may also be provided so that the handle, wipers, or tension adjustment arms may not be moved outward beyond the end of springs 585A and 585B by the user during spring tension adjustment.

Figure 6:
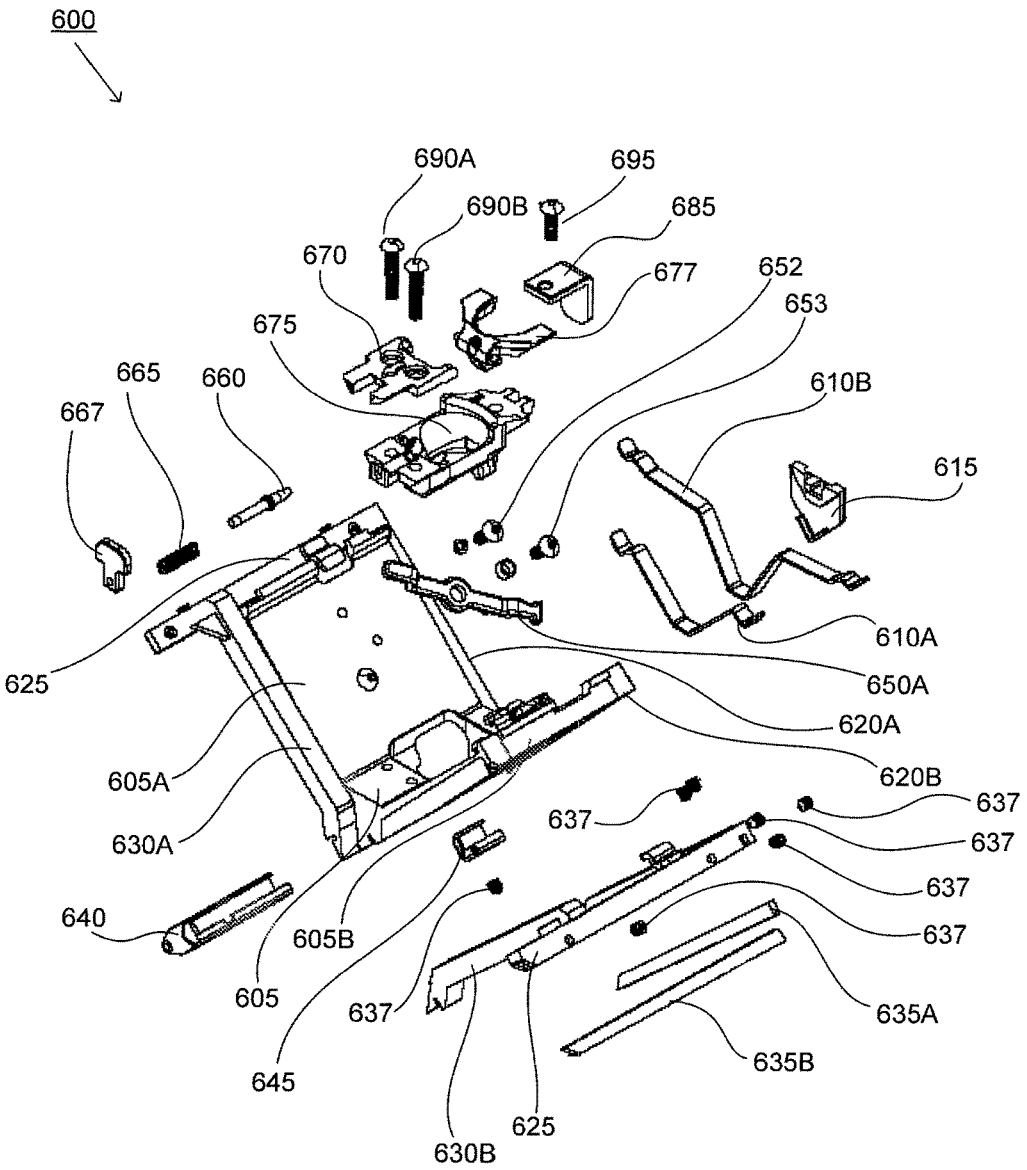
FIG. 6 illustrates an exploded perspective view of a corner finishing tool, according to at least one exemplary embodiment of the invention.

Referring now to FIG. 6, a partial exploded perspective view of a corner finishing tool 600 is provided, according to at least one exemplary embodiment of the invention. In this figure the corner finishing tool has various parts shown separately and some parts connected together as they would be after assembly. In this embodiment, an interior wall section 605 is provided including a left side wall 605A and a right side wall 605B. The left side wall 605A and a right side wall 605B may be flat on the interior portion so as to easily accommodate one or more tension adjustment mechanism(s). Although not shown, on the opposite face side (facing outward from the tool), of the interior wall section 605 may include valleys or concave portions to accommodate accumulation and/or distribution of mud or mastic during use. A plurality of blade tension springs 610A and 610B for a frame tension system may be provided and may be assembled to the upper interior section of the interior wall section 605 with a face plate 615. Note that in this embodiment the tension springs are each of a different length. A center bent portion of the blade tension springs 610A and 610B may be retained between a portion of the interior wall section 605 and a back angled lip portion of the face plate 615. The face plate 615 may be attached to the interior wall section 605 by a bracket 685 and screw 695. The spring tension may also include a tension adjustment mechanism that may be a tension adjustment handle, wiper, or arm 650A on the left side wall 605A. The tension adjustment handle, wiper, or arm 650A may be attached via screw 653 that may be inserted through a bushing and/or washer about which the tension adjustment handle, wiper, or arm 650A may pivot. Further, a screw 652 with a washer and/or bushing may be used as a stop so as to limit the pivoting of the tension adjustment handle, wiper, or arm 650A. Various embodiment may also include a second tension adjustment handle, wiper, or arm mounted on the interior wall section 605 right side wall as show in this figure.

As illustrated, a first left side of a frame system may be coupled to surround the left side wall 605A, and may include a working blade side 620A, a running blade side 625A, and a lower frame side 630A (blades not shown). The frame system may also include a second right side that may be coupled to surround the right side wall 605B, and may include a working blade frame side 620B, a running blade frame side 625B, and a lower frame side 630B. Working blade frame side 620B may have a working blade 635A coupled therein, and may be retained therein using, for example, set screws 637A and 637B. Running blade frame side 625B may have a running blade 635B coupled therein, and may be retained therein using, for example, set screws 637C and 637D. A running blade height adjustment set screws 637E and 637F may also be provided in the running blade frame side 625B. It is noteworthy that the working blade 635A and running blade 635B may be face outward on the frame system and be of an approximately same or similar size and shape so as to be interchangeable with each other and the left side frame related blades, and that they may be inserted in the frame system with opposite sides inserted into, for example, a channel formed in the frame system and an angled end placed in opposite directions away from one another with right angle ends oriented in the frame so as to be adjacent one another. Similar blade arrangements, attachments, and adjustment mechanization may be arranged on the outside of the left side frame system. The frame system may be coupled to the interior wall section using, for example an interlocking tab arrangement (described with respect to FIG. 5) and/or one or more retaining clips 640 and 645 that may attach one end of frame section 630A, 630B, 620A, and 620B to a top and bottom center portion of the interior wall system formed to include, for example, attachment grooves. The retaining clips may have spring force and may be made of, for example, a spring steel or a metal typically used for flexible and strong retention clips.

The corner finishing tool 600 may also include a handle and/or application box coupling system that may include a base section 675 having, for example, a hemispherical well or socket area, a coupling lip, and a mounting area for coupling a U shaped or C-shaped (not shown) ball locking and releasing door 677. A cover 670 may be provided for attaching the U shaped or C-shaped (not shown) ball locking and releasing door 677 by locking ends of two hinge pins on the door between the cover 670 and the base section 675. A locking and release pin 660 may be included and placed along with a spring 665 into a hole or channel formed in the lower end of the base section 675. One end of the pin 660 may interface with the door 677 to lock, release and/or hold open the door 677 during the introduction or removal of, for example, a ball, into the socket area of the base 675. The cover may also retain the pin 660 in the case a channel is formed in the base 675. In any case, a handle or tab 667 may be attached to an opposite end of the pin 660. As such, a user may open or release the door 677 by moving the handle or tab 667 downward against the force applied by spring 665 until the door 667 opens, and when the user lets go of the handle or tab 667 the spring 665 force may push the other end of pin 660 into an ear or indent on the door 677, so as to hold the door in an open position. Insertion of a ball end into the socket and door 677 may automatically close the door and allow the pin 660 to enter a hole in the base of the door 677, thereby automatically locking the door in a closed position.

Figure 7A:
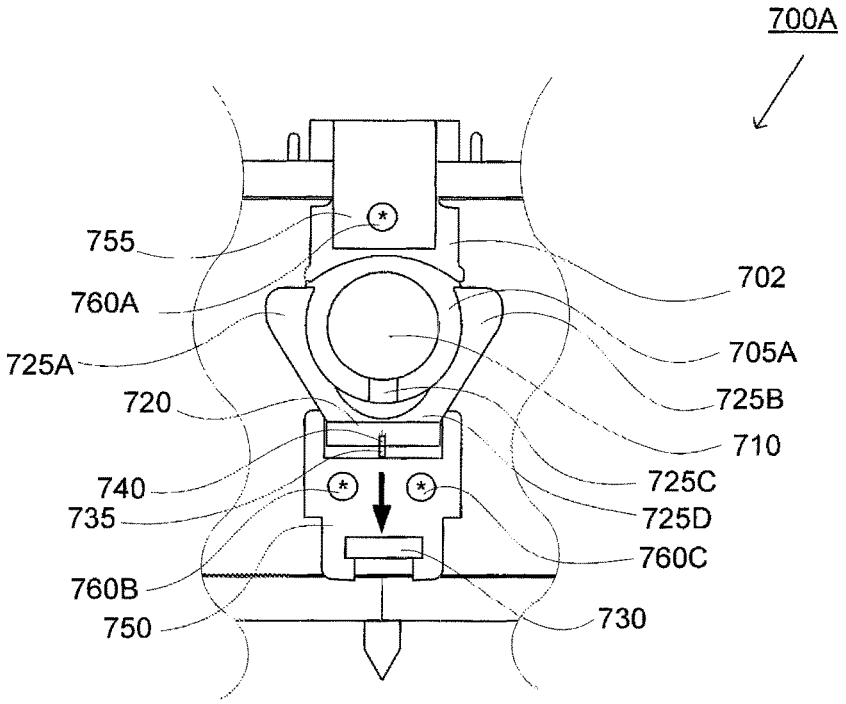
FIG. 7A illustrates a plan view of a portion of the tool corner finishing tool showing the coupling ball latching system in a closed condition, according to at least one exemplary embodiment of the invention.

Referring now to FIG. 7A, a plan view of a portion of the tool corner finishing tool showing the coupling handle and/or applicator box latching system 700A in a closed condition is shown, according to at least one exemplary embodiment of the invention. The coupling handle and/or applicator box latching system 700A may include a base section 702 that may be attached to the interior wall section via, for example, screws 760A, 760B and 760C. The screws 760B and 760C may also attach a cover plate 750 and screw 760A a bracket 755. The base section 702 may include a socket or hemispherical area 710 into which a ball may be placed into for providing a mud or mastic applicator box or handle to the corner finishing tool. A U-shaped or C-shaped door 725 may be included to have a left and right arm 725A and 725B and rear arm 725C. The rear arm 725C may be in the closed door position into an open channel in the lower portion of the hemispherical area 710. The door 725 may be coupled to the base section 702 via, for example, an elongated hinge pin or hinge pin ears/studs (not shown) that may be sandwiched or grasped between the base section 702 and the cover plate 750. In this illustration the door is in the closed position and a nub or ridge 740 may be included on the bottom area of the door face and the door 725 may be locked in a closed position by, for example, a pin or lock and release mechanism 735 that may be inserted into a through hole, indent, or dimple formed in the lower or hinged side of the door 725. The pin or lock and release mechanism 735 may be spring loaded and may be connected to a handle or tab 730. A handle or tab 730 may be moved downward (in the direction indicated by the arrow) by a user to release the door 725 so that it may pivot on the hinge pin or tabs resulting in the top end of each of the left arm 725A, right arm 725B, and the rear arm 725C to move forward for releasing and/or receiving a ball of a coupling handle, feed tube, or applicator box as is shown in FIG. 7B and described in more detail below.

Figure 7B:
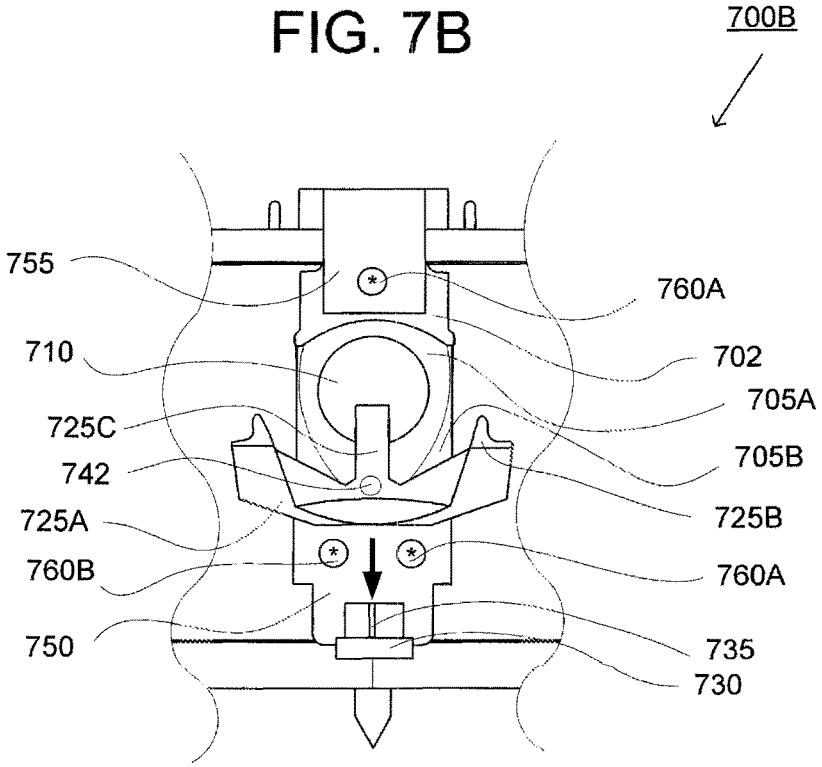
FIG. 7B illustrates a plan view of a portion of the tool corner finishing tool showing the coupling ball latching system in an open condition, according to at least one exemplary embodiment of the invention.

Referring now to FIG. 7B, a plan view 700B of a portion of the tool corner finishing tool showing the coupling handle and/or applicator box latching system in an open condition, according to at least one exemplary embodiment of the invention. In this case, the U-shaped or C-shaped door 725 may be pivoted outward away from the base section 702. In this position, the top end of each of the left arm 725A and right arm 725B are extended outward from the base section 702 and cover plate 750. The back arm 725C moves forward and upward based on its curved or sloped shape and position relative to the pivot point of the door 725. The door 725 may be held in an open position by the pin or shaft 735 applying pressure via, for example, a coil spring attached to the pin or shaft, and its position relative to, for example, a nub or ridge 740 formed on the lower portion of the front face of the door 725. The combination of the spring loaded pin or shaft 735 and the nub or ridge 740 may be such that the door may be released to pivot to the closed position by applying pressure (using for example a coupling ball) to the back arm 725C. The door may then automatically lock closed by the pin or shaft 735 entering, for example, a locking hole 742 that may be formed through the bottom side of the door 725.

Figure 8:
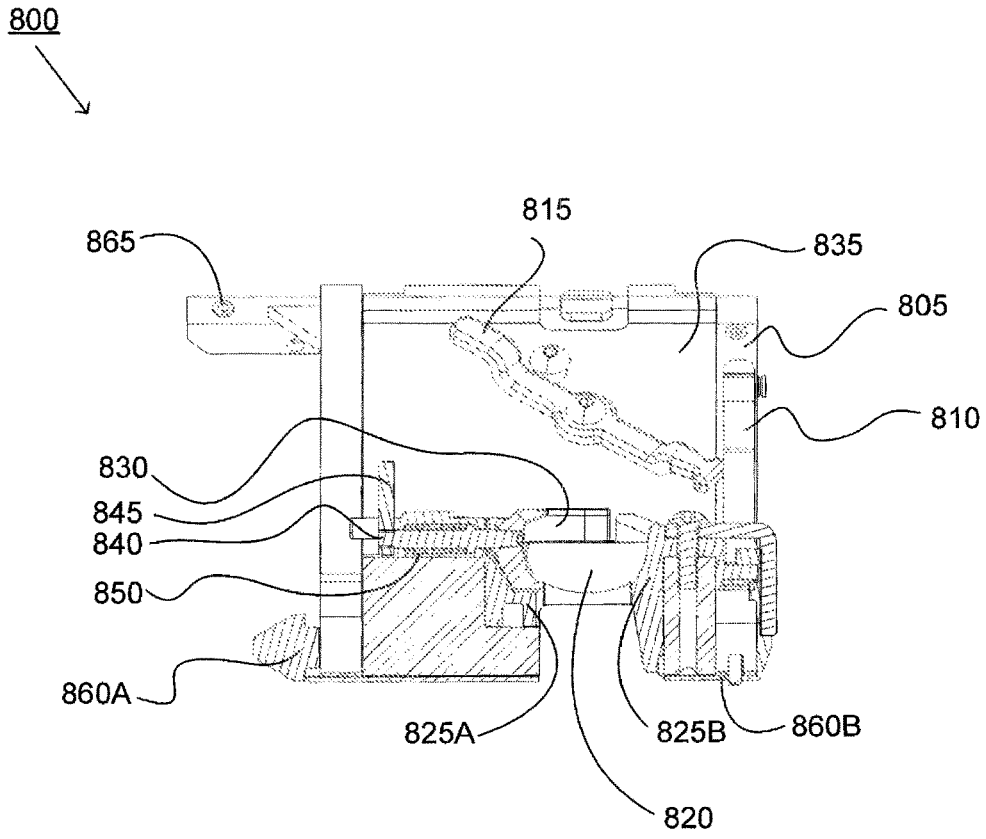
FIG. 8 illustrates a section view of the corner finishing tool taken through a center of the finishing tool (top to bottom) showing the coupling ball latching system in a closed condition according to at least one exemplary embodiment of the invention.

Referring now to FIG. 8, a section view 800 of a corner finishing tool taken through a center of the finishing tool (top to bottom) showing the coupling ball latching system in a closed condition is provided, according to at least one exemplary embodiment of the invention. In this embodiment, the corner finishing tool may include frames 805 which may retain and control tool blades (not shown). The frame(s) 805 may be secured to the tool body or wall(s) 835 by, for example, clips 860A and 860B. Further these frames may be biased to the corner forming walls by, for example, one or more biasing spring(s) 810. As noted above, different types and/or sizes of finishing tools may have one or more biasing springs 810 and the biasing force may be adjusted by removing one or more spring(s) 810 from contact with the frames 805 by, for example, the rotation of the levers 815. These components working in conjunction with the blades comprise the primary systems which controls the amount and quality of the mud or mastic that is applied to the wall.

The ball coupling end of the handle or applicator box may rest in the hemispherical surface 820 of the ball joint 825A and 825B. This surface may interact with approximately ½ of the ball coupling. In various embodiments, the upper half of the ball coupling may only be partially engaged. This partial engagement may be accomplished by the door 830. The door 830 may cover over just enough of the ball end (not shown in this figure) to lock in or retain it into the ball joint 820, 825A and 825B. The door 830 may operates on a hinge and spring loaded arrangement. In order to lock the hinged door from operation and thereby retain a coupling ball, the door may be locked in place by, for example, a locking pin, post, or shaft 840. The locking pin, post, or shaft 840 may be biased into the door by, for example, a compression spring 850. In order to remove the locking pin, post, or shaft 840, thereby allowing the door to rotate open and release or receive a coupling ball, the user may pull the lock pin tab or handle 845 against the force of the compression spring 850.

Figure 9:
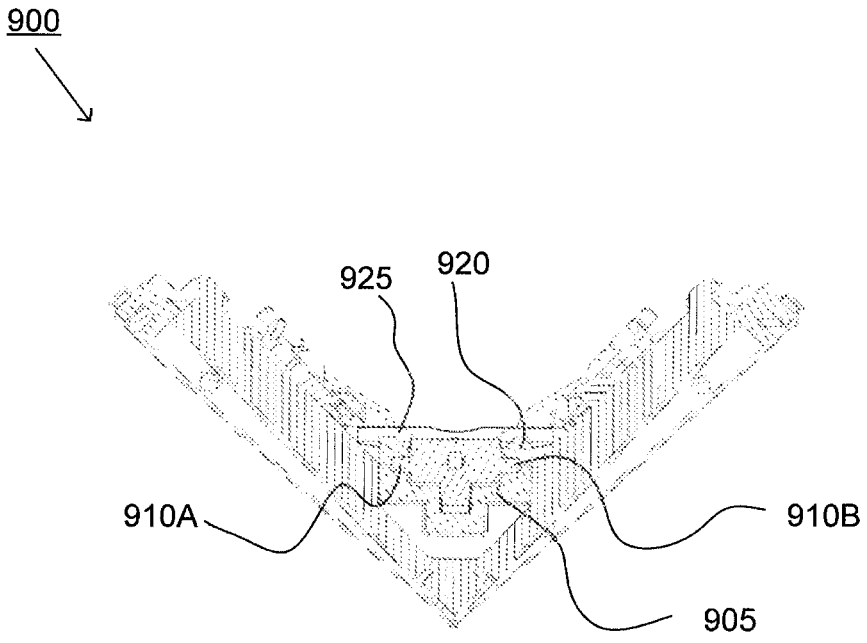
FIG. 9 illustrates a detailed a section view of the corner finishing tool taken through a door hinge system, according to at least one exemplary embodiment of the invention.

Referring now to FIG. 9, this figure illustrates a detailed a section view of the corner finishing tool taken through a door hinge system, according to at least one exemplary embodiment of the invention. In this sectional view one can see an example of one possible hinged configuration for the quick release and retention ball and socket arrangement for the present invention. The hinged door 925 may rotate about integral hinge pins 910A and 910B, or a separate hinge pin that may be inserted through a hole in the door 925. The hinge pin(s) may be sandwiched or trapped in, for example, a tubular cavity created by the mating of geometry in the base plate ball and socket female portion joint part 555 and the central cover plate 920. This rotation may allow a coupling ball end of a handle or applicator box cone to be retained in and released from the corner finishing tool.

Figure 10:
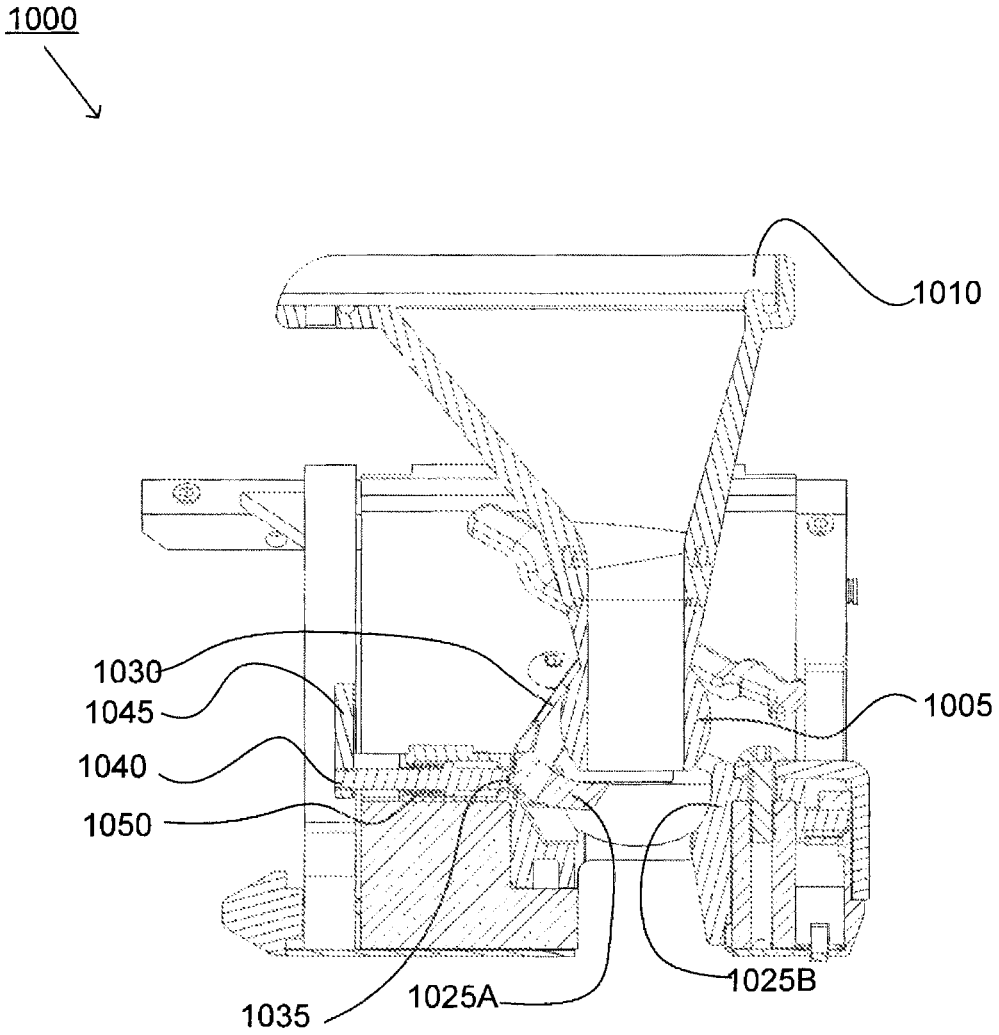
FIG. 10 illustrates a section view of a corner finishing tool taken through the center of the finishing tool (top to bottom) showing a coupling ball latching system including a portion of a mastic applicator box, according to at least one exemplary embodiment of the invention.
Figure 11:
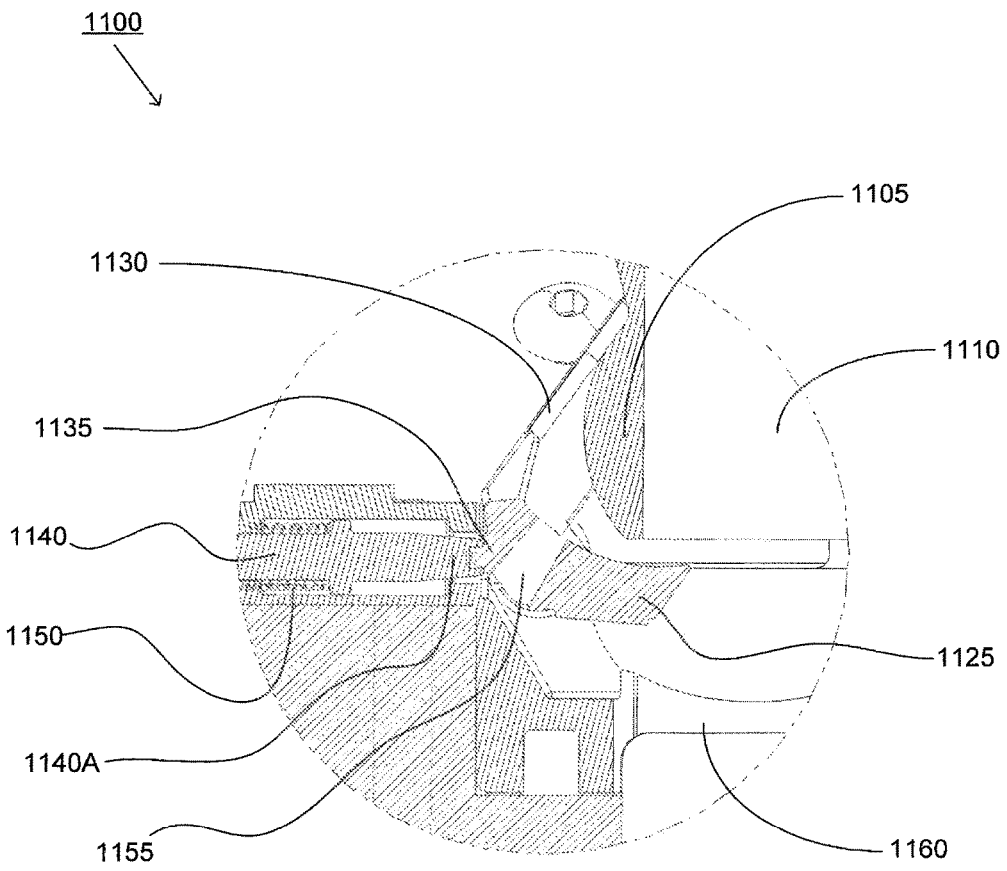
FIG. 11 illustrates a partial section view through the center of a corner finishing tool (top to bottom), showing the coupling ball latching system in an open condition, according to at least one exemplary embodiment of the invention.

Referring now to FIGS. 10 and 11, the detail and operation of the coupling ball latching system will be described for a better understanding of at least one of the embodiments of the invention. FIG. 10 is a section view of a corner finishing tool taken through the center of the finishing tool (top to bottom) showing a coupling ball latching system including a portion of a mastic applicator box is provided, according to at least one exemplary embodiment of the invention. FIG. 11 illustrates a partial section view through the center of a corner finishing tool (top to bottom), showing more clearly a portion of the coupling ball latching system in an open condition, according to at least one exemplary embodiment of the invention. Referring first to FIG. 10, one uniqueness of various embodiments of the invention may be that when the door 1030 is rotated open and the coupling ball 1005 is released, the relieved end of the lock pin or post 1040 may engage with a door holding means, for example, a raised protrusion 1035 or an indent or hole in or on the door 1030. The compression spring 1050 may bias the end of the pin, shaft, or post 1040 against the door protrusion or ridge 1035. In so doing, these features may interlock and cause the door 1030 to be held in an open position. This open position retention may allow for the corner finishing tool to be quickly changed from one handle or an applicator box mastic output cone 1010 to another by only operating the release mechanism, tab, or handle 1045 once or needing to hold the latch 'open'. Referring now to FIG. 11, it can be seen more clearly an embodiment having a latching system with one end 1140A of the pin, post, or shaft 1140 having an indent or hole formed therein and surrounding a ridge or bump 1135 of the door 1130. This configuration may assist in maintaining the latching system door 1130 in a held open state for receiving a handle or applicator box ball end. During attachment or reattachment of the corner finishing tool to a handle or to an applicator box mastic output cone 1110 coupling ball 1105, the user need only insert the end of the coupling ball 1105 into the corner finishing tool so that when the coupling ball end 1105 engages a protruding arm 1125 (e.g., the center arm 725C) located extending outward from the lower hemispherical area 1160 of the door 1130 and ball joint 1160. The coupling ball end 1105 may engage the center protruding arm 1125 of the door 1130 and thereby cause the door 1130 to be rotated about, for example, a hinged axis and move in the direction of a latched position. The door 1130 may be closed by a small force generated in the latching direction which may causes the lock pin, post, or shaft 1140 to release the door latching protrusion 1135 from its hole or indented end 1140A. Once released from the latched open position, the lock pin, post or shaft 1140 and compressed compression spring may aid in rotating the door to a closed position. When the door reaches the closed position the lock pin, post, or shaft 1140 may lock the door 1130 into place by, for example, being driven into the locking hole 1155 that may be formed in the door 1130. In at least one embodiment, both the pin end 1140A and door locking hole 1155 may have matching tapers so as to improve ease of insertion to a locking position and reduce or eliminate the effect of part manufacturing tolerances. For example, the tapered pin end 1140A and door locking hole 1155 may result in larger and smaller parts being driven together to different depths as their relative sizes may vary in manufacturing or due to wear over time. The result is that the engagement is not loose. This firm engagement may result in a door 1130 being held firmly in the latched position without significant play, thereby holding the tool properly on the ball end 1105 where it is free to rotate, but not come off unless the door latch system is released.

Referring now back to FIG. 10, one can appreciate that this latching system embodiment may be very user friendly in that the user need only pull the door latch tab or handle 1045 once to release the corner finishing tool from a handle or applicator box. Once released, the user need no longer hold the latch tab or handle 1045 or door 1130 open, as it does that automatically by its mechanical configuration. Nor does a user need to reactivate the latch, tab or handle 1045 or door 1130 to attach the corner finishing tool to a handle or applicator box, since he can insert a ball end 1005 into the ball and socket latching system and it will automatically override the door open detente position (shown more clearly in FIG. 11), close the door (1030, 1130), and lock it in position with no further user interaction. In addition, this latching system may be produced with relatively few components so as to be produced using relatively low cost production methods. Still further this ball and socket latching system may be inherently strong, may not present any sharp edges that may produce high rates of wear, and may be resistant to binding from the mastic or mud environment resulting from the moving parts being held in positions which limit the intrusion of mastic or mud into the working regions of the latching system components.

As discussed above, various embodiments of the present invention may be designed to apply the mastic or mud to a building surface, such as wall or ceiling corners, in an efficient and effective manner that results in a desired pattern of mastic or mud on the wall so as to finish a corner where two sheets of wall board or drywall material meet. A desired pattern may include one or more layers of mastic or mud that when dry appears to be smooth, flat, and fill in, for example, a corner and preferably needs a minimal amount of work (e.g., sanding or further mastic or mud coating) to be considered complete. To obtain such performance, the frame and blade system for mastic or mud shaping and distribution along with the frame and blade spring tension system may be designed for interchangeability, adjustability, and performance.

Figure 12:
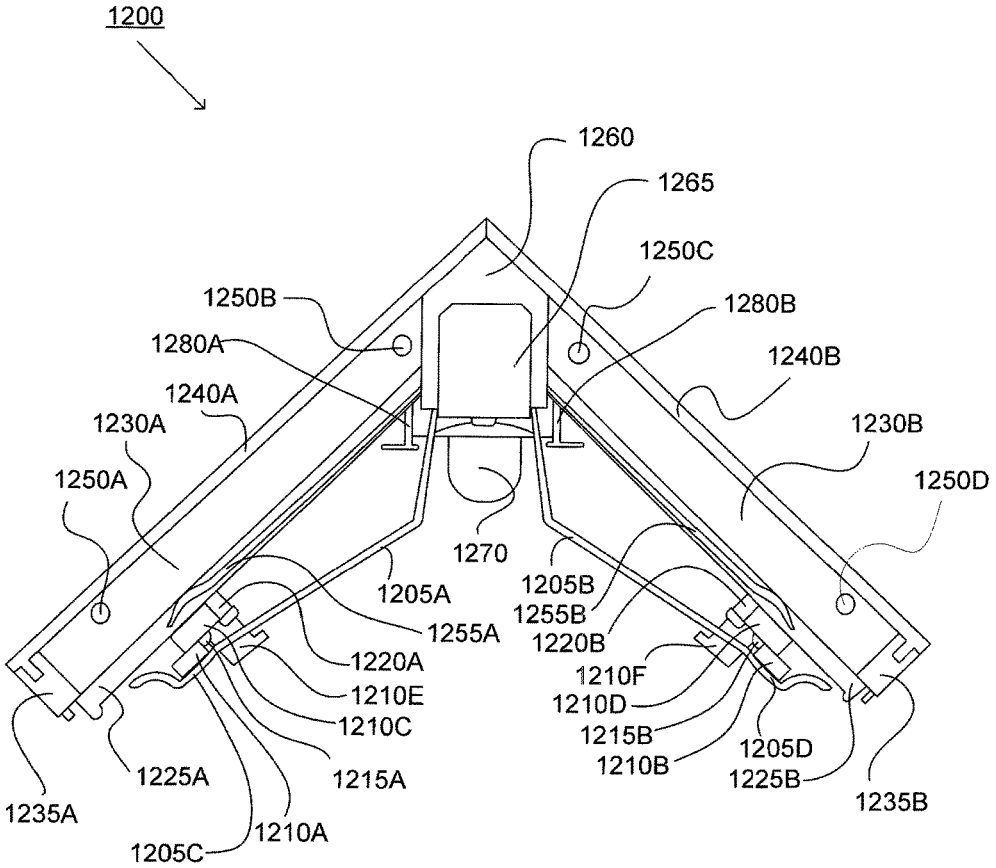
FIG. 12 illustrates a top view of a corner finishing tool, according to at least one exemplary embodiment of the invention.

Referring now to FIG. 12, a top view of a corner finishing tool, according to at least one exemplary embodiment of the invention. This figure provides another perspective of a corner finishing tool 1200 that illustrates a top view of frame and blade section, a handle and/or application box coupling system, and a frame spring tension system, according to at least one embodiment. The frame and blade system shown may include a left side working blade 1240A and working blade frame 1230A, and a right side working blade 1240B and working blade frame 1230B. A left side running blade and frame 1235A and right side running blade frame 1235B are also shown. The left side working blade 1240A may be held in the working blade frame 1230A by, for example, two attachment means such as screws or set screws 1250A and 1250B. The right side working blade 1240B may be held in the working blade frame 1230B by, for example, two attachment means such as screws or set screws 1250C and 1250D. The center of the frame section may be held in place with a face or top plate 1260. The face or top plate 1260 may be held to the interior wall section by, for example, a bracket 1265. A plurality of blade tension springs 1205 and 1255 for frame tension may be provided and may be assembled to the upper interior section of the interior wall section 1255A and 1255B with face plate 1260. The first tension spring may have two multiple bend sides, 1205A, 1205C and 1205B, 1205D. The multiple bent sides may have a relatively long straight side 1205A and 1205B that is at an angle to the plane of the inside wall of the corner finishing tool, and a relatively short straight side 1205C and 1205D that are approximately parallel with the inside was surface of the corner finishing tool. Note that in this embodiment the tension springs 1205 and 1255 are each of a different length, but they may be the same length. A center bent portion of the blade tension springs 1205 and 1255 may be retained between a portion of the interior wall section 1255 and a back angled lip portion of the face plate 1260. The spring tension may also include a tension adjustment mechanism that may be a tension adjustment handle, wiper, or arms 1210 on the left side and right side. The tension adjustment handle, wiper, or arm 1210 on the left side may include a wiper portion 1210A that interfaces with the inside of spring 1205, a main section 1210C that may be attached via a screw 1215A to the inside wall 1225A, and a handle portion 1210E that may be moved by a user. The wiper portion may operate to separate the spring(s) 1205 from interfacing with the left side frame section 1230A so that less tension is applied to the working blade 1240A. A screw that may include a washer and/or bushing may be used as a stop so as to limit the pivoting of the left side of tension adjustment handle, wiper, or arm 1210. The tension adjustment handle, wiper, or arm 1210 on the right side may include a wiper portion 1210D that interfaces with the inside of spring 1205, a main section 1210B that may be attached via a screw 1215B to the inside wall 1225B, and a handle portion 1210F that may be moved by a user. A screw that may include a washer and/or bushing may be used as a stop so as to limit the pivoting of the right sides of tension adjustment handle, wiper, or arm 1210. In any case, the tension adjusting handle, wiper, and/or arm may be used to lift and separate the left, right, or both sides of tension spring 1205.

The top view shown in FIG. 12, also shows the quick connect/disconnect system of the present invention, From this view, a top view of the activation tab/handle 1270 and a door left arm 1280A and right arm 1280B may be seen from a different perspective.

Figure 13:
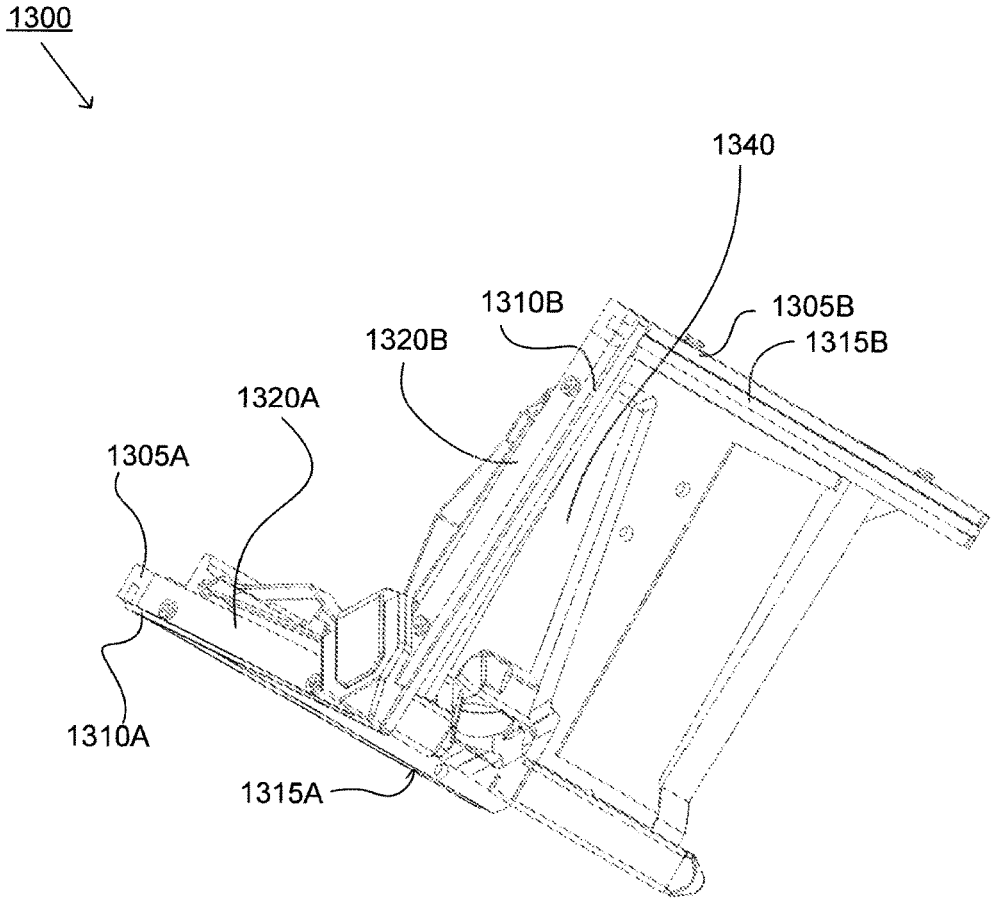
FIG. 13 illustrates a perspective view of a corner finishing tool looking from the outside top, according to at least one exemplary embodiment of the invention.

Referring now to FIG. 13, a perspective view of a corner finishing tool looking from the outside top, according to at least one exemplary embodiment of the invention, is provided. As previously discussed, the present invention may include a mastic or mud shaping and distribution system so that the mud being pushed out to the opening may be distributed on a wall, ceiling, or working surface according to a desired amount and shape. This mastic or mud shaping and distribution system may include, for example, a group of blades that may include two blade holding frames 1305A and 1320A, and 1305B and 1320B, right and left sides with a working blade and running blade sides each, respectively. These two blade holding frame sides may include, for example, four blades that may be working blades 1310A and 1310B and running blades 1315A and 1315B. The blade(s) may be made of a durable and relatively rigid (at least in one direction) material that may resist scratching and corrosion, for example, carbide, stainless steel, or high carbon steel and may include a protective coating of chrome, titanium nitride, etc.

Figure 14:
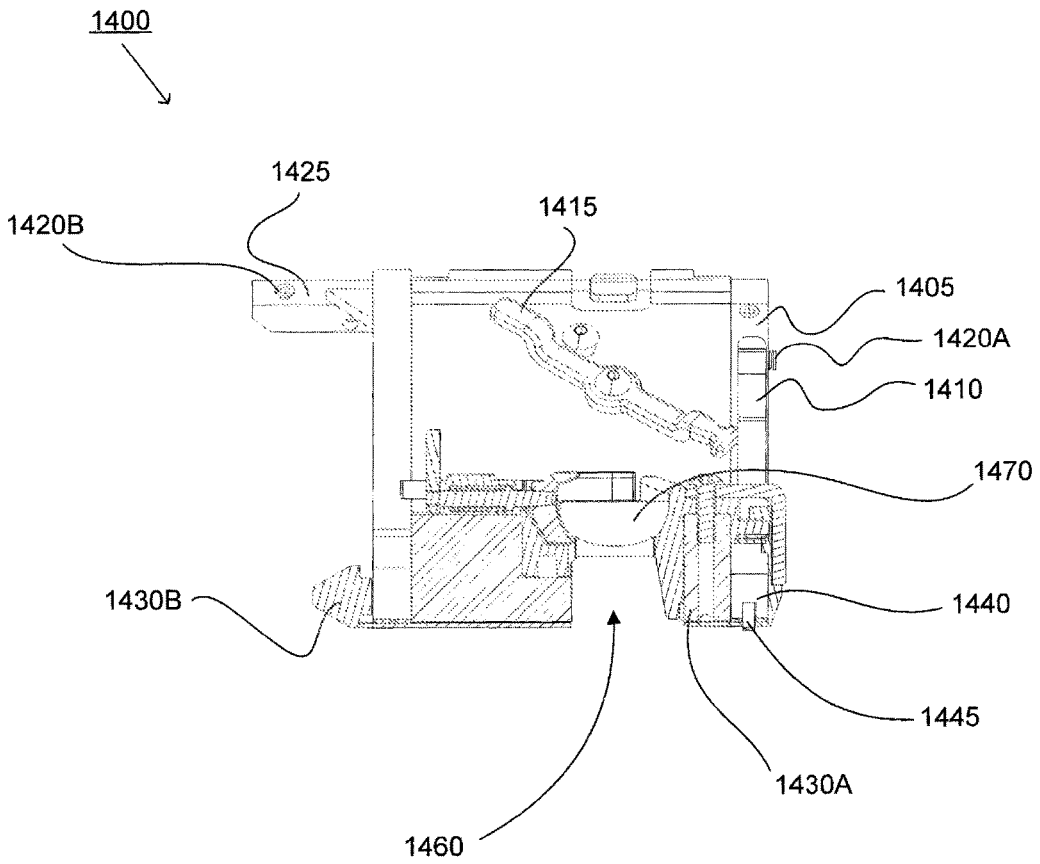
FIG. 14 illustrates a section view of a corner finishing tool taken through the center of a corner finishing tool (top to bottom), showing the coupling ball latching system in a closed condition, according to at least one exemplary embodiment of the invention.

Referring now to FIG. 14, a section view of a corner finishing tool 1400 is provided and is taken through the center of a corner finishing tool (top to bottom), showing the coupling ball our latching system or quick connect/disconnect system in a closed condition, according to at least one exemplary embodiment of the invention. Various methods or means of holding and adjusting the blade assembly may be used. For example, as described above, the mastic or mud shaping and distribution system may include one or more a spring system(s) (spring 1410) that may be used for applying one or more predetermined force(s) or load(s) on the blades depending on the needs of the wall or ceiling corner finishing process. The blades may be embedded in the blade holding frames (see FIG. 9, Items 127, 128) in a slot or channel 1440 formed lengthwise in the frames 1305A and 1320A, and 1305B and 1320B. The blades, e.g., 1445, may be held in place by, for example, set screw(s) 1420A, 1420B. The frames may be supported in the tool with one or more retaining clips 1430A and 1430B. These clips 1430A and 1430B in combination with the tool body or walls may retain the frame in all axial directions. The clips 1430A and 1430B may allow for rotation of the frame and blade combination about the central vertex or approximately right angle corner of the tool 1400. In this way, the corner finishing tool may adjust for various imperfections in corner geometry which may not be the desired perfect 90 degrees by e.g., +−5 degrees. The frames may be biased against a working surface (e.g., walls and/or ceiling) to the angle that the corner was constructed to be by the biasing forces of the frame tensioning system that may include one of more leaf springs 1410 which may be secured to the body or walls of the corner finishing tool and act upon the frame(s) 1405 and 1425. The result is that the blades may be forced or retained against the wall(s), ceiling and/or floor of a building construction (e.g., room) which form a corner. When mud or mastic flows out of the tool through port 1460, from, for example, an applicator box or hollow handle, which directs mud into the corner finishing tool 1400 from the central ball joint area 1470, it may flow into cavities adjacent to the working blades (FIG. 13, item 1340). In this way, mastic or mud may be applied to the working surface (e.g., a wall, ceiling, and/or floor) and then spread into the desired geometry (e.g., flat and approximately 90 degree corner) by flowing under the working blade(s) 1445 based on force(s) input from the corner finishing tool, mastic or mud dispensing system, and the tool operator. The corner finishing tool may also be used (e.g., with only a handle attached to the corner finishing tool) when mud or mastic has already been applied to the wall. In this case, the corner finishing tool may function only to spread the mud into the appropriate pattern and to remove any excess from the corner. In any case, better results may require that the blade(s) 1445 be smooth and may include small beveled edges without defects such as nicks, dents, chips, scratches, etc., from one end to the other including the relatively sharp or pointed end.

Figure 15:
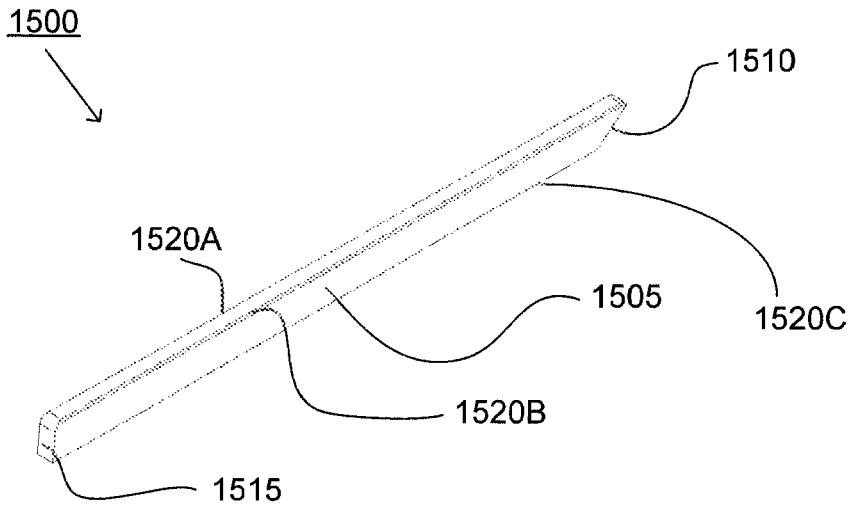
FIG. 15 illustrates a perspective view of a blade for a corner finishing tool, according to at least one exemplary embodiment of the invention.

FIGS. 15-19 provide a more detailed illustration of the blades and frame, according to various exemplary embodiments of the invention. Referring now to FIG. 15, a perspective view of a blade 1500 for the corner finishing tool, according to at least one exemplary embodiment of the invention is shown. This blade is designed to be interchangeable as either a working blade or a running blade. The blade(s) 1500 may be designed and manufactured (or remanufactured) to be a smooth elongated length 1505 and may include small beveled edge(s) 1520B that runs laterally along its length on one or more edges. One end of the blade 1500 may be approximately perpendicular to the lateral length and the other end 1520 may be formed at an angle that may be slightly less than 45 degrees from the plane of the lateral length 1505. Ideally, the blade 1500 should be without defects such as nicks, dents, chips, scratches, etc., from the relatively flat perpendicular end 1515 to the other end relatively pointed angled end 1510.

The abrasive aspects of the "mud", the presence of screws or nails which may not be properly set in the wall surface, or dropping the tool may all adversely affect the blade 1500 and may cause it to be nicked, chipped, scratched, or broken. A blade 1500 with any of these defects will result in a corner finishing tool that will perform poorly and leave an uneven surface behind requiring further work by the builders (e.g., more filling and/or sanding). Further the tendency of the corner finishing tools, especially the larger dimension corner finishing tools, to move in a non-smooth manner along the wall can have similar results and cause additional work to even the corner surfaces. The non-smooth movement is typically caused by the width along the direction of motion (i.e., the running blade length) to be generally less than the length that the frames reach to (i.e., the working blade length), commonly known as the size of the tool. The equal dimensions of various embodiments of the corner finishing tool according to the present invention may help to solve these problems by using a 'square' geometry for all size corner finishing tools and a reversible blade that may be used as either/or a working blade or a running blade. As such, in various embodiment(s), the frame of the corner finishing tool may be roughly equal in its length along the direction of motion (height) and the direction of frame reach (width), or corner finishing tool size. For example, corner finishing tools of width sizes such as 9-10 cm may have a length of approximately 9-10 cm, and the same blade may be used for either a working blade and/or a running blade.

Figure 16:
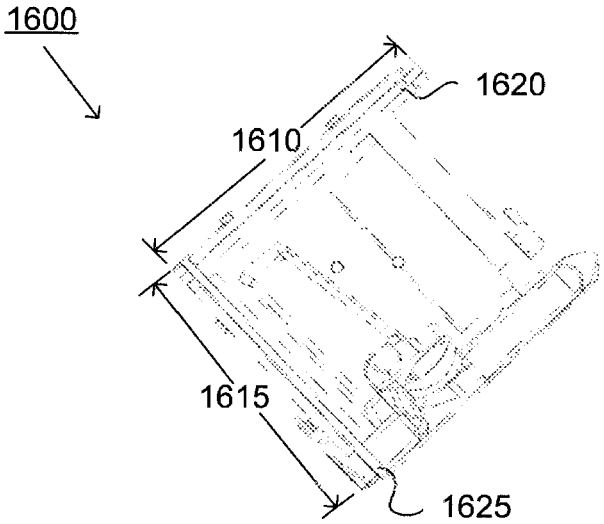
FIG. 16 illustrates a side view of one side of a corner finishing tool, according to at least one exemplary embodiment of the invention.

Referring now to FIG. 16, a side view 1600 of one side of a corner finishing tool, according to at least one exemplary embodiment of the invention is provided to illustrate the approximately equal length of the sides 1610 and 1615 of a larger corner finishing tool. With this approximately square geometry the larger tools (e.g., 9 cm and greater) have a greater length (or width) along the direction of motion, e.g., along the running blade 1620 length. This may result in a tool that may move more smoothly along a corner regardless of tool size, with no need of rollers or other methods of improving the tools motion, and the use of the same (reversible) blade to be used interchangeably. As such, the refined size aspect may then allow for the use of a novel blade construction where the same blade, e.g. 1500, may be use as the working blade 1625 and/or the running blade 1620 by simply turning the blade so that a different side 1520A or 1520C is facing outward and not placed in the blade holding groove or channel formed in the frame. The same blade 1500 may be used as a working blade 1625 by placing side 1520C into the blade holding groove or channel of the frame, thus leaving side 1520A and bevel 1520B facing outward to interface with a working surface. Alternatively, that blade 1500 may be used as a running blade 1610 by placing side 1520A into the blade holding groove or channel of the frame, thus leaving side 1520C facing outward to interface with a working surface.

Figure 17:
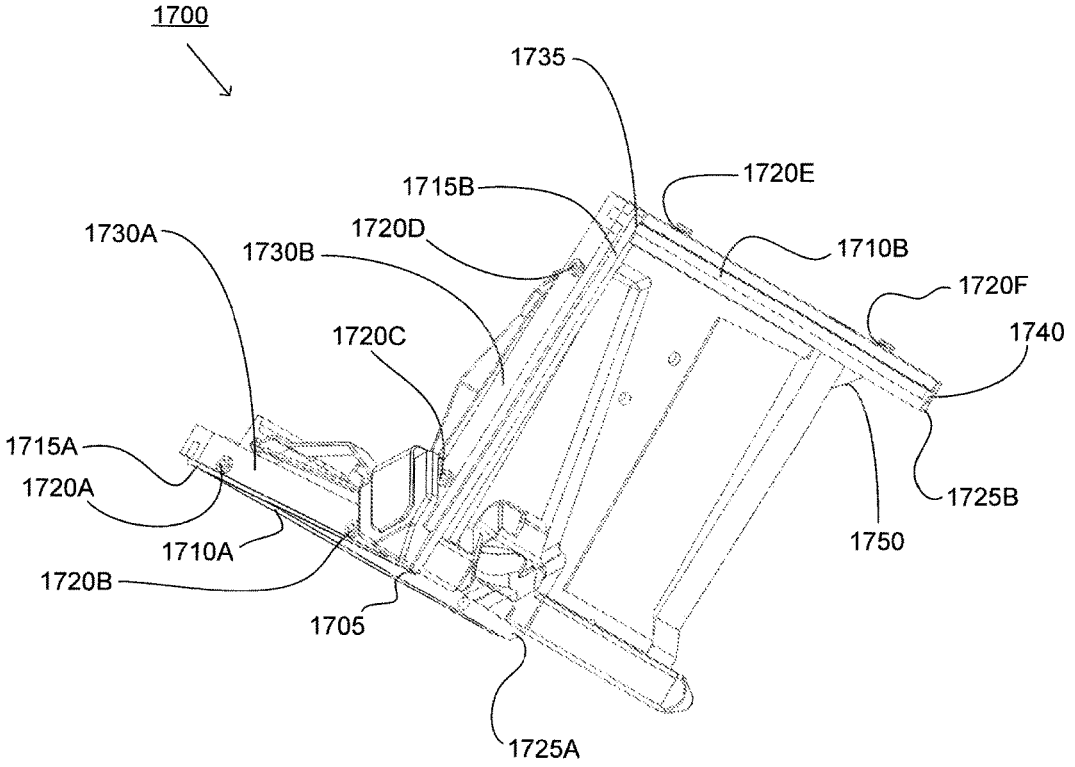
FIG. 17 illustrates a perspective view of a corner finishing tool looking from the outside top, according to at least one exemplary embodiment of the invention.

Referring now to FIG. 17, a perspective view of a corner finishing tool 1700 looking from the outside top, according to at least one exemplary embodiment of the invention, is provided to better explain the equal length frame design and interchangeable/reversible aspects of the blade design. In this exemplary embodiment, the working blades 1715A and 1715B may be oriented such that their respective points meet at the vertex 1705 of the corner finishing tool 1700 which may impart the correct shape, for example an inside corner shape, to the mastic or mud while in use. The running blade(s) 1710A and 1710B may have the pointed end of the blade set into the groove or channel at the leading edge of the running side of the frames 1725A and 1725B with the angled surface becoming a sloped smooth surface in the direction of tool motion. In various embodiments the intersection of the angle and the elongated flat surface of the running side of the blade(s) may have a rounded corner so that the corner finishing tool may be less likely to grab or gouge the working surface upon which it transverses. In either case, this geometry may act like the runner of a sled flowing smoothly along the working surface, e.g., a wall, during use. This overall corner finishing tool and blade configuration may thus results in the working surface for use as a "working" blade, to be exposed. However, that same blade (e.g., see FIG. 15, item 1500) may be inserted into the groove or channel of the opposite side exposed when used as a "running" blade. The reverse is also true that the blade may be inserting as a "working" blade and have the opposite elongated side (with or without beveled edge) become the interface with a working surface by placing the blade in the groove or channel with the running blade portion or surface of the blade being held inside the groove or channel of the working blade portion of the frame. In any case, the flat end 1515 of the blade 1500 used as a running blade 1710A and 1710B may be adjacent and abutting the side surface portion of the working blade 1715A and 1715B, respectively, so as to form a closed interface 1735. The blades may be held in the grooves or channels of the frames with various holding means, for example, screws or set screws 1720A-1720F.

As a result of this unique approximately equal leg length frame and reversible universal blade construction, the user may have the benefit of spare blades found directly on the tool in case one or more working edges of the blade(s) should be damaged by chipping, nicking, denting, etc., during use. For example, if a working blade elongated side of a blade (e.g., 1715A or 1715B) hits a raised screw and chips when used in one of the working frame sides 1730A or 1730B, that blade (e.g., 1715A or 1715B) may be removed from the working blade frame side, turned over and reversed in orientation, and switched with one of the blades (e.g., 1710A or 1710B) in a running blade frame side 1725A or 1725B. In doing so, the user will flip over and reverse the blades so as to expose the opposite surface (preferably new and not previously used surfaces) which were previously inside and protected by one of the frame grooves or channels. The previously used and/or chipped surface may now likewise be hidden inside one of the frame channels where it does not affect tool performance and the resulting smoothness of a working surface (e.g., drywall corner surface smoothed with mastic or mud). Further since all four blades on every tool may now be identical in shape, the blades may be switched form side to side as well, resulting in many combinations of defective surfaces being accommodated such that the corner finishing tool may be set up as 'new' or almost as good as new, by placing imperfect or damaged surfaces inside the frame channels, leaving perfect or undamaged blade surfaces available for proper tool function or swapping blades from side to side so that a primary edge to interface the working surface is more close to being perfect or with fewer or no imperfection(s).

Another unique feature of the present invention is the design of the grooves or channels for the blades that are formed in the frames. In various embodiments of the present invention the grooves or channels in the frames for holding the blade may be formed so that the blades main surfaces may not be parallel to the frame, resulting in one or more blades being at a slight angle relative to the normal outer surface of the blades and thereby the working surface of, for example, a wall, ceiling, or floor.

Traditional corner finishing tools in this category require relatively high precision for the orientation of the blades in the frames in order to have the tool function properly. This is currently accomplished through the use of set screws projecting through the frames in both the working and running portions. Typical setup of the tool requires a trained technician and precision fixturing. The tool is set into a corner replicating fixture with the blades held loosely in the frame grooves. The blades are then biased such that they meet at the tool vertex and the running blades are biased such that they abut the working blade leaving no gap for mud to flow through where they blades meet at the outer corners of the tool. The set screws located at the top surface of the frames are then screwed into the frames until the blades are biased against the fixturing surface. The fixture surface sets both the height of the blades, their angle in the channels, and the relative height where they but against each other. Each of these geometry characteristics is important for proper tool function. Once positioned, a second set of set screws projecting through the side of the frame are tightened which locks the blade in place. The net result is that the blades are supported on set screws which have been set to a relatively precision depth and are then locked in place by a second set of retaining set screws. This setup is typically done at the factory or by trained technicians at specified repair locations.

Figure 18:
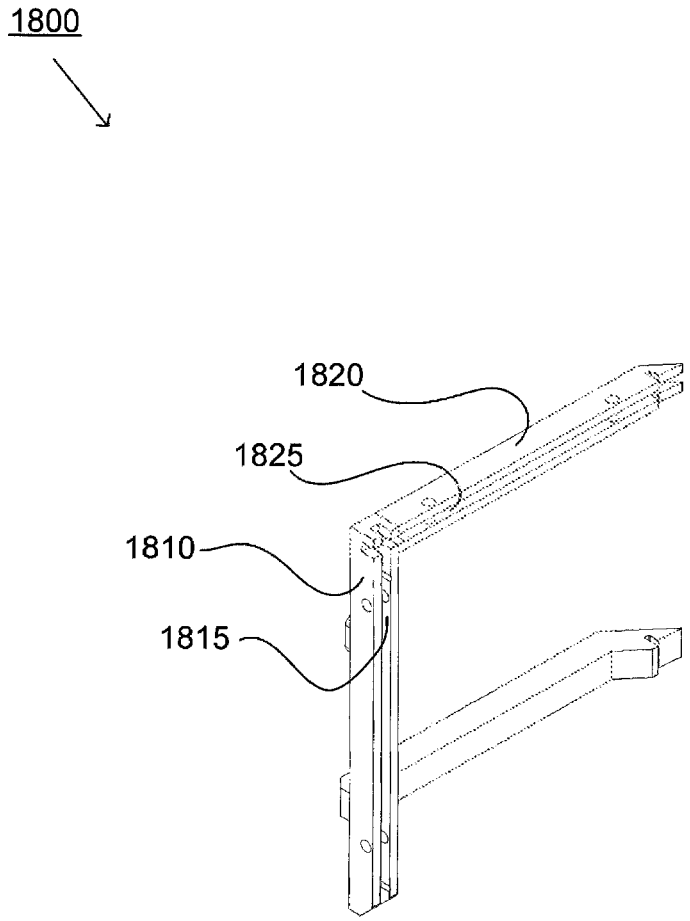
FIG. 18 illustrates a perspective view of a frame for holding blades, according to at least one exemplary embodiment of the invention.

On the other hand, the present invention significantly reduces the complexity of setting up the blades in the corner finishing tools with proper blade geometry and height, through the novel use of simple geometry. Referring now to FIG. 18, a perspective view of a frame for easily holding the blades in the proper orientation without cumbersome skilled training and additional tooling for precision adjustment is provided, according to at least one exemplary embodiment of the invention. One objective is that where the blades butt against each other, the running blade surface should be the same height or slightly less than the working blade so that the end of the running blade does not catch on a working surface or cause an indent or ridge in the mastic or mud. This may be accomplished by the running blade groove 1815 of the running blade frame side 1810 being formed (e.g., milled) at, for example, approximately 0.1 mm deeper than the working blade groove 1825 of the working blade frame side 1820, to compensate for normal variation in manufacturing tolerances of the frame(s) and blade(s). Of course a large variation in the depth may be used, but if too large the running blade may not completely limit the lateral extension of additional mud or mastic.

In any case, under typical manufacturing tolerances for the present invention, this may result in blade surfaces that are flush to only slightly lower on the running blade than the working blade. Referring now back to FIG. 17, as a result of the corner finishing tool's geometry the blade height at the tools vertex 1705 may be required to be less than the height at the outer location where the running blade is located (e.g., 1735). Additionally, the leading edge (e.g., 1740) of the running blades 1710A and 1710B may be lower than the blade height where they butt against the working blades 1715A and 1715B.

Figure 19A:
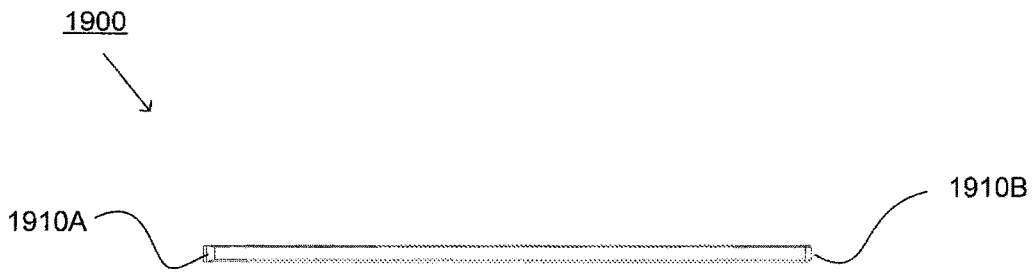
FIG. 19A illustrates a top view of a blade for a corner finishing tool, according to at least one exemplary embodiment of the invention.
Figure 19B:
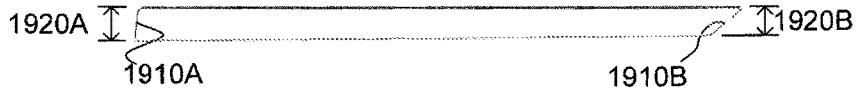
FIG. 19B illustrates a side view of a blade for a corner finishing tool, according to at least one exemplary embodiment of the invention.

Referring now to FIGS. 19A and 19B, a top view and a side view, respectively, of a blade for a corner finishing tool is provided, according to at least one exemplary embodiment of the invention. With the working blade's and running blade's blade lengths being the same, the resulting form a "rectangular" corner finishing tool geometry, which means that the blade height at the running blade leading edged and the tool vertex may be approximately the same 0.5-1.0 mm. Therefore, in various embodiments of the present invention, the length of the blades may be made the same so that the blades are not long rectangles as is typical of prior art, and may be tapered from one end to the other so as to be typically 0.5-1.5 mm taller at the squared off end 1910A than they are at the pointed end 1910B, such that the blade height 1920A may be approximately 0.5-1.5 mm taller than blade height 1920B, forming a slight taper along the length of the blades. This unique frame and blade geometry may allows the working blades (e.g., 1715A and 1715B) to be placed in the frames with the tips aligned at the tool vertex and tightened in place using, for example, set screws or screws (see FIG. 17, items 1720A-1720F). Then the running blades (e.g., 1710A and 1710B), which may be the same blade design that is place in a relative reversed and upside down orientation to the working blades, may then be place in the running channels of the frames and biased against the working blades and tightened in place with the retaining set screws (see FIG. 17, items 1720A-1720F). This simple set up allows a typical corner finishing tool user with basic mechanical skills typical to replace or correct a damaged blade quickly on the job site, significantly reducing down time as compared to current corner finishing tools which require return and fixing or replacement by trained and/or skilled personnel using special tools and equipment. The corner finishing tool may also, but need not, have a second set of positioning set screws (see FIG. 8, item 865) assembled into the frame in order to allow for traditional precision set up should a frame become bent or significant blade wear occurs requiring raising one or more blade locations. The frequency of this type of action may be greatly reduced through the use of ultra hard blade and/or frame material, for example, Carbide blades which may be two times the thickness of the industry standard blade. Additionally, the frames may be extra strong, for example, an 8 mm×8 mm frame, made of Stainless steel, and may include reinforcing gussets (see FIG. 17, item 1750) where desire to reduce of eliminate frame bending even under heavy use or dropping or many abnormal conditions. It is also noteworthy that as can be seen in various figures, e.g., FIGS. 8, 10, 13, 14, 16, 17, and 20, the frame section of the running blades may also extend beyond the wall section and may act to absorb shock if dropped and protect the inner walls from damage, or also act as leg-type supports for when storing the corner finishing tool on, for example, a shelf.

Figure 20:
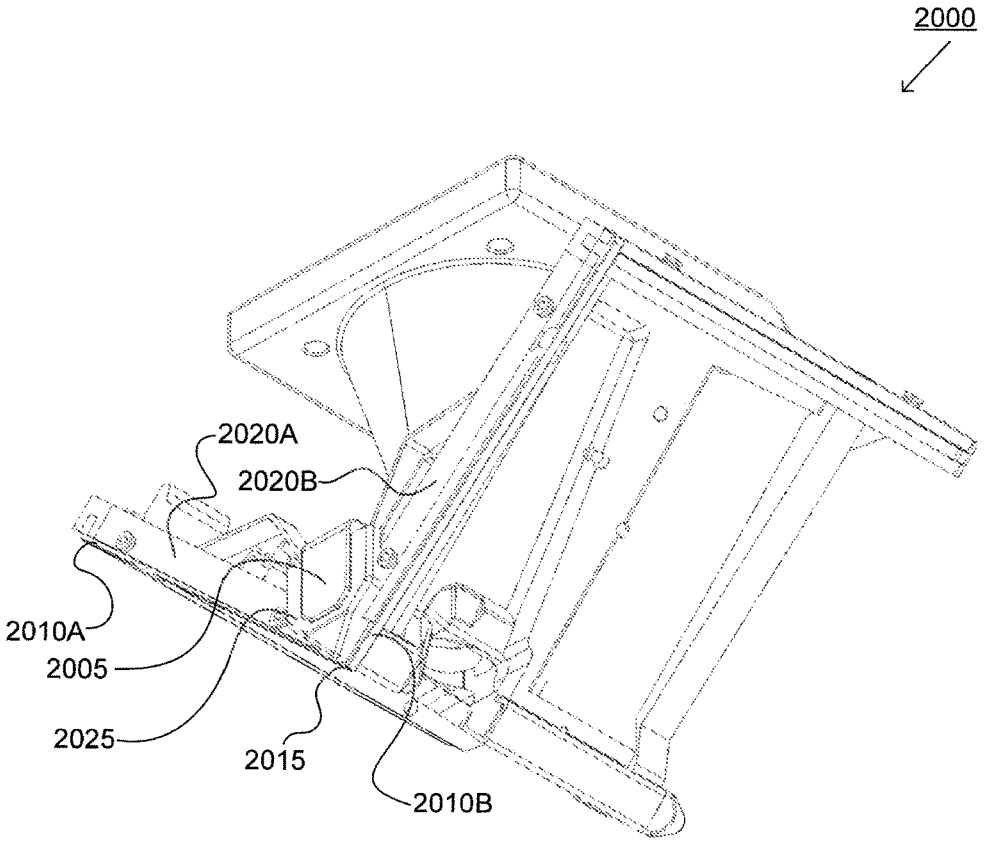
FIG. 20 illustrates a perspective view of a top and side of a corner finishing tool with a cone of a mastic applicator attached looking at it from a top and side, according to at least one exemplary embodiment of the invention.

In still further variations of the invention, a novel face plate construction may be employed. FIG. 20 illustrates a perspective view of a top and side of a corner finishing tool with a cone of a mastic applicator attached looking at it from a top and side, according to at least one exemplary embodiment of the invention. The face plate structure of various embodiments may utilize a two piece construction. The face plate 2025 may, for example, cover the front of the frame up to and abutting the front face of the blades. The face plate may be retained by a bracket 2005 which may be fastened by, for example, a screw to the tool body or inner wall section (see also FIGS. 5 and 6).

Figure 21:
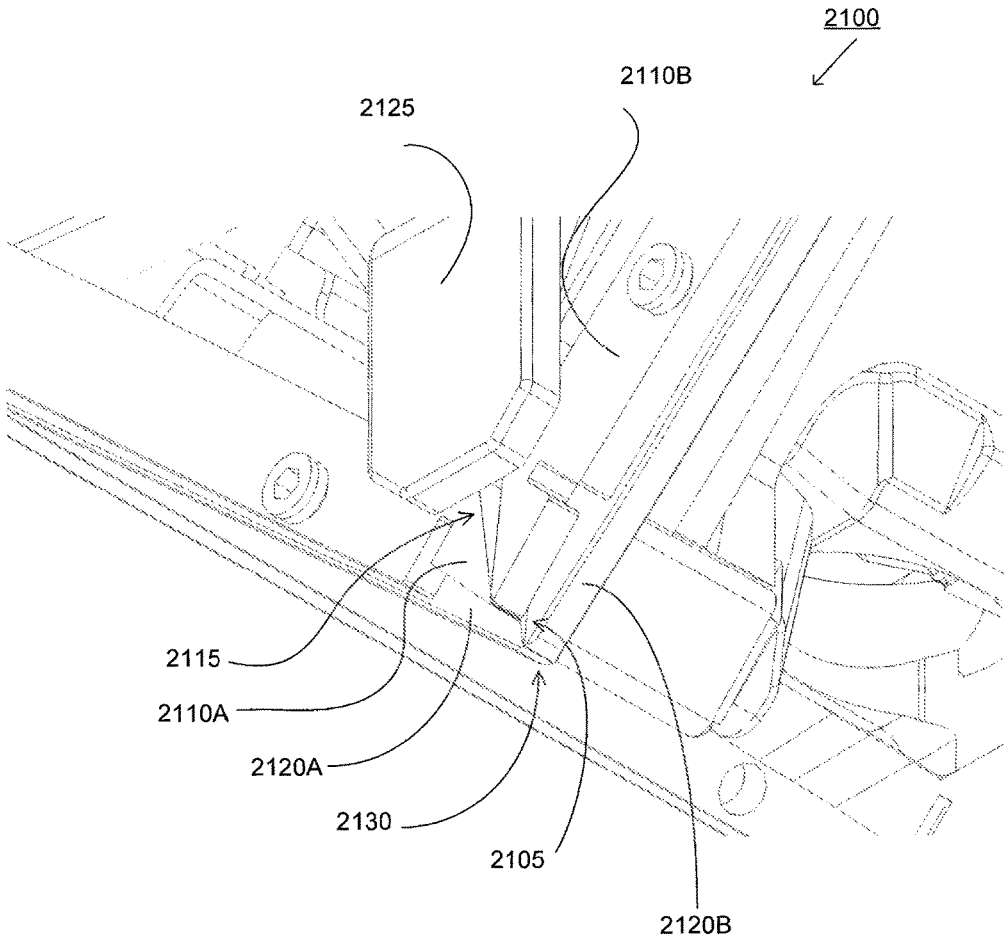
FIG. 21 illustrates a partial perspective view of a corner finishing tool with a front plate removed, according to at least one exemplary embodiment of the invention.

Referring now to FIG. 21, a partial perspective view of a corner finishing tool 2100 is provided with a front plate removed, according to at least one exemplary embodiment of the invention. This construction is advantageous over prior art because it may improve tool cleaning capability and may, perhaps more importantly, fill the gap 2105 that occurs between the blades 2120A and 2120B and the gap 2115 between the frames 2110A and 2110B, as well as the gaps therebetween the blades and frames at the vertex of the tool 2130. Without being covered, these gaps may allow mud or mastic to leak through and result in a defect (e.g., a ridge or bump) in the corner which may require subsequent finishing to correct. This potential defect may be increased by, for example, either improperly set up tool or blades which may be chipped near the 'sharp' tip of one or both working blades 2120A and 2120B.

Figure 22:
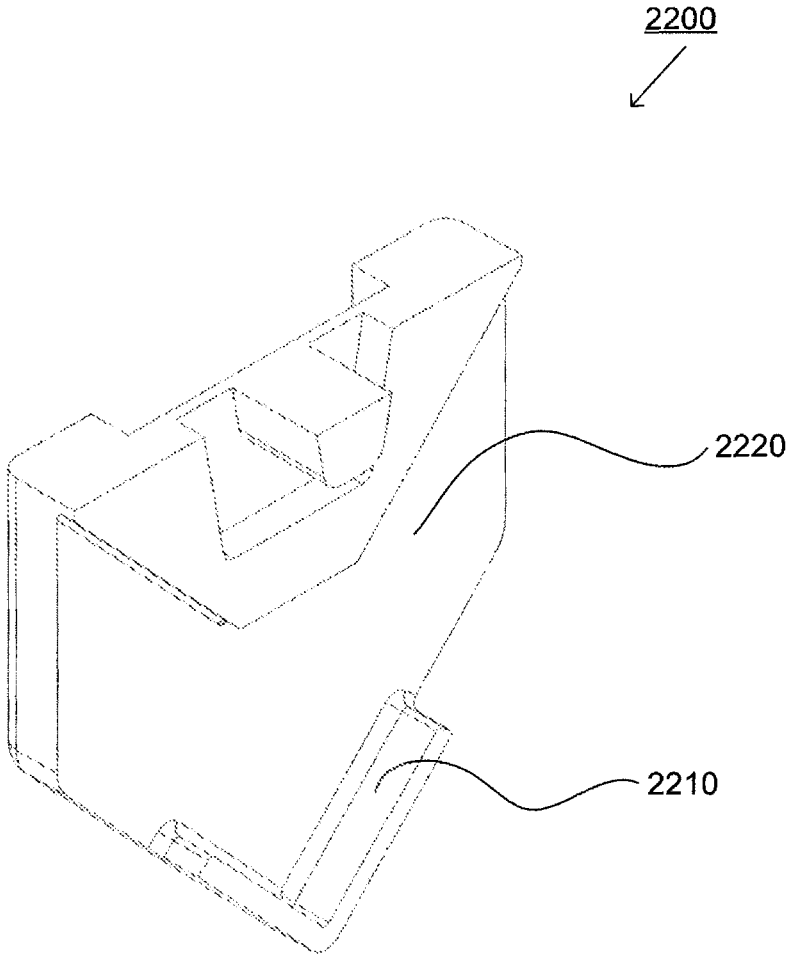
FIG. 22 illustrates a perspective view of a front plate for a corner finishing tool, according to at least one exemplary embodiment of the invention.

Referring now to FIG. 22, a perspective view of an exemplary front plate or frame cover or holder 2200 for a corner finishing tool is provided, according to various embodiment(s) of the invention. The face plate 2200 may include a lip, front wall, or protrusion 2210 that wraps around the front corner or vertex of the frames 2110A and 2110B and may completely cover the gap 2115 in the frames and most of the gap 2105 in the blades and a top wall or capping surface 2220 that goes over the top corner vertex where the frames 2110A and 2110B come together. This aspect of the preferred embodiment does not allow mud or mastic to flow out the front of the tool except under the blades. Further the vertex of the front plate may be abutting, adjacent to, and/pr very near the vertex of the blades 2120A and 2120B themselves. Therefore, with the use of the front plate or frame cover or holder 2200, a chipped blade or a gap between blades may result in a smaller defect in the mud or mastic than for traditional tool configurations, thus resulting in a reduced need for additional processes to correct the defect. In this way the corner finishing tool of the present invention may add still further advantages to the user resulting from its ability to function properly even when there are defects in the blades which would require a traditional corner finishing tool blade to be repaired or replaced.

Figure 23:
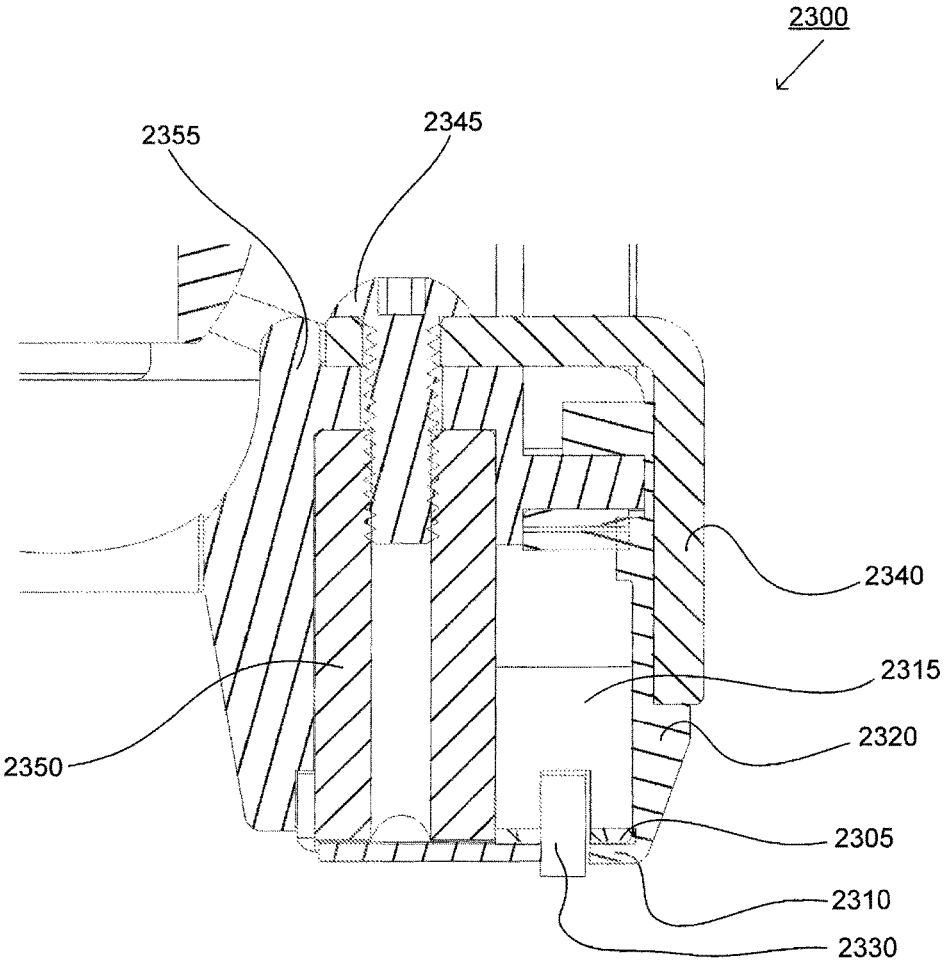
FIG. 23 illustrates a partial section view taken through the center (top to bottom) of a corner finishing tool including a front plate system, according to at least one exemplary embodiment of the invention.

FIG. 23 illustrates a partial section view 2300 taken through the center (top to bottom) of a corner finishing tool including a front plate system, according to at least one exemplary embodiment of the invention. From this perspective, as assembled, one can more clearly see how the face plate 2320 lip, front wall, or protrusion 2310 may cover the front corner or vertex of the top of the frames 2305 ((only one showing in this cross-section view) and may completely cover a gap 2315 that may formed between the meeting of the two frame sides. Also, it is more clear from this figure how the face plate 2320 lip, front wall, or protrusion 2310 is adjacent to and may touch or almost touch the blades 2330 (only one showing in this cross-section view). The configuration of how the bracket 2340 holds down the face plate 2320 and may be attached via, for example a screw 2345, to the wall section 2350 of the corner finishing tool, along with a base plate 2355 of the quick connect/disconnect socket and latching system, may also be more clearly understood from this cross-sectional view.

Although particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

What is claimed is:

1. An apparatus, comprising:

a mud or mastic working tool, including, a latching assembly consisting of a hinged door which engages a mating geometry on at least two sides, wherein the latching assembly is configured to releasably couple two construction tools together in a ball and socket arrangement.

2. The apparatus of claim 1, wherein the hinged door is a C or U shape.

3. The apparatus of claim 1, wherein a door hinge pin is integral to the hinged door.

4. The apparatus of claim 1, wherein the hinged door is latched in place by a pin projecting through a hole in the hinged door.

5. The apparatus of claim 4, further comprising:

a housing, wherein the pin is movable and engages with a locking mechanism that is mounted to or integral to the housing.

6. The apparatus of claim 1, wherein the hinged door and a latch pin have mating features which cause the hinged door to detent in the open position.

7. The apparatus of claim 1, an approximately ninety degree housing including:

at least two housing sections that come together at a peak; and a blade having multiple sections and a frame that wraps around at least a portion of the periphery of the housing; and; and a front face plate that wraps around the frame and covers a gap where the multiple sections of the frame meet at a point or vertex of the mud or mastic tool.

8. An apparatus, comprising:

a mud or mastic working tool, including:

a housing with a plurality of at least four blade sections located around its periphery;

a first blade section;

a second blade section attached to and at approximately a right angle to the first blade section;

a third blade section attached to and at approximately a right angle to the first blade section, in the same plane as the first blade section, but in a different plane than the second blade section;

a forth blade section attached to and at approximately a right angle to the second blade section, in the same plane as the second blade section, but in a different plane that the first blade section;

a first blade in the first blade section;

a second blade in the second blade section;

a third blade in the third blade section; and a fourth blade in the fourth blade section, wherein the first blade, the second blade, the third blade, and the fourth blade have approximately the same geometry.

9. The apparatus of claim 8, wherein the first blade, the second blade, the third blade, and the fourth blade are interchangeable.

10. The apparatus of claim 8, wherein the first blade and the second blade, and the third blade and the fourth blade, are mirror images of one another.

11. The apparatus of claim 8, wherein the working surfaces of at least two of the first blade, second blade, third blade, and forth blade are not parallel to the other opposed surface.

12. The apparatus of claim 8, wherein the first blade, the second blade, the third blade, and the fourth blade each have one end which is approximately pointed and not rounded, while the other is not.

13. The apparatus of claim 8, further comprising:

a front face plate that wraps around a portion of at least two of the first frame, the second frame, the third frame and the fourth frame, and the face plate covers a gap where at least two of the first frame, the second frame, the third frame and the fourth frame meet at a vertex of the mud or mastic working tool.

14. The apparatus of claim 8, further comprising:

a wall section of the housing having a generally flat inner wall.

15. The apparatus of claim 8, further comprising:

a latching assembly consisting of a hinged door that when closed will retain a handle or nozzle connection to the mud or mastic working tool.

16. The apparatus of claim 15, wherein the hinged door includes a movable pin there through for securing and/or releasing the movable door, and the movable door and movable pin have mating features which cause the door to detent in a semi-fixed state in the open position.

17. The apparatus of claim 16, wherein the movable pin engages with a locking mechanism that is mounted to or integral to the housing.

18. An apparatus, comprising:

a mastic corner finishing tool, including:

a first blade section;

a second blade section attached to, in the same plane with, and at approximately a right angle to the first frame section;

a first blade in the first blade section; and a second blade in the second blade section, wherein the first blade and the second blade have approximately the same geometry.

19. The apparatus of claim 18, wherein the first blade is a working blade and the second blade is a running blade and the first blade and the second blade are interchangeable.

20. The apparatus of claim 19, wherein the first blade and the second blade are mirror images of one another.

* * * * *